US008100061B2

(12) United States Patent
Hookway et al.

(10) Patent No.: US 8,100,061 B2
(45) Date of Patent: Jan. 24, 2012

(54) ITEM SUPPORT APPARATUSES AND SYSTEMS FOR BEDSIDE

(75) Inventors: Scott Hookway, Batesville, IN (US); Dawn Michelle Riley, Sunman, IN (US); G. Brent Fagan, Batesville, IN (US); Dennis James Gallant, Harrison, OH (US); Charles A. Howell, Batesville, IN (US); Jack Barney Sing, Batesville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 12/483,568

(22) Filed: Jun. 12, 2009

(65) Prior Publication Data

US 2009/0307843 A1 Dec. 17, 2009

Related U.S. Application Data

(60) Provisional application No. 61/061,420, filed on Jun. 13, 2008.

(51) Int. Cl.
*A47B 37/00* (2006.01)

(52) U.S. Cl. ..... 108/50.01; 108/49; 108/26; 108/93

(58) Field of Classification Search ..... 108/26, 108/93, 147, 108, 150, 106, 189, 191, 152, 108/49, 50.01
See application file for complete search history.

(56) References Cited

U.S. PATENT DOCUMENTS

| | | | |
|---|---|---|---|
| 1,217,676 | A | 2/1917 | Wilson |
| 1,232,757 | A | 7/1917 | Berkey |
| 1,256,498 | A | 2/1918 | Baker |
| 1,472,570 | A | 10/1923 | Snider |
| 1,653,657 | A | 12/1927 | Pretsch |
| 1,775,877 | A | 9/1930 | Waples |
| 1,797,847 | A | 3/1931 | Vandagriff |
| 1,862,237 | A | 6/1932 | Pepler |
| 1,888,124 | A | 11/1932 | Pulaski |
| D132,427 | S | 5/1942 | Hillenbrand |
| D132,953 | S | 7/1942 | Hillenbrand |
| D134,456 | S | 12/1942 | Hillenbrand |
| D135,340 | S | 3/1943 | Hillenbrand |
| D135,341 | S | 3/1943 | Hillenbrand |

(Continued)

FOREIGN PATENT DOCUMENTS

DE 36 23 344 C1 11/1987

(Continued)

OTHER PUBLICATIONS

International Search Report/Written Opinion for International App. Ser. No. PCT/US2009/047202 completed Jul. 17, 2009.

(Continued)

*Primary Examiner* — Hanh V Tran
(74) *Attorney, Agent, or Firm* — Barnes & Thornburg LLP

(57) ABSTRACT

An item support apparatus, such as an overbed table, for example, includes a support surface assembly, a base assembly, and a vertical column coupled to each of the support surface and base assemblies. A side assembly is coupled to the base assembly and configured to remain stationary while the support surface assembly moves upwardly and downwardly relative to the base assembly. The overbed table may further include a hand sanitizer container coupled with the support surface assembly and configured to receive a removable hand sanitizer container unit. The base assembly may include weight-activated casters. Other embodiments are also disclosed.

34 Claims, 20 Drawing Sheets

U.S. PATENT DOCUMENTS

| | | | |
|---|---|---|---|
| D135,507 | S | 4/1943 | Hillenbrand |
| 2,321,204 | A | 6/1943 | Hillenbrand |
| 2,329,902 | A | 9/1943 | Hillenbrand |
| 2,342,631 | A | 2/1944 | Hillenbrand |
| 2,346,919 | A | 4/1944 | Hillenbrand |
| 2,352,837 | A | 7/1944 | Hillenbrand |
| 2,357,588 | A | 9/1944 | Hillenbrand |
| D149,793 | S | 6/1948 | Burst |
| 2,456,415 | A | 12/1948 | Hillenbrand |
| 2,483,920 | A | 10/1949 | McLean et al. |
| 2,580,032 | A | 12/1951 | Lindelof |
| 2,605,155 | A | 7/1952 | Lewis |
| 2,614,018 | A | 10/1952 | Engel |
| 2,628,147 | A | 2/1953 | Berner |
| 2,733,110 | A | 1/1956 | Berner et al. |
| 2,749,197 | A | 6/1956 | Smith |
| 2,795,473 | A | 6/1957 | Smith |
| 2,848,290 | A | 8/1958 | Doty |
| 3,089,743 | A | 5/1963 | Heyl |
| 3,094,949 | A | 6/1963 | Oom |
| 3,188,986 | A | 6/1965 | La Vigne |
| 3,301,406 | A | 1/1967 | Scott |
| 3,380,405 | A | 4/1968 | Barecki et al. |
| 3,504,643 | A | 4/1970 | Burst et al. |
| 3,574,434 | A | 4/1971 | Propst et al. |
| 3,682,112 | A | 8/1972 | Emrick |
| 3,715,995 | A | 2/1973 | Thomas |
| 3,715,997 | A | 2/1973 | Barth |
| 3,854,428 | A | 12/1974 | Fullenkamp |
| 3,890,907 | A | 6/1975 | Peterson |
| 3,905,311 | A | 9/1975 | Carpentier |
| 3,908,565 | A | 9/1975 | Burnett |
| 3,910,659 | A | 10/1975 | Peterson |
| 3,963,288 | A | 6/1976 | Burnett |
| 4,038,709 | A | 8/1977 | Kerwit |
| 4,077,333 | A | 3/1978 | Ballas |
| 4,183,015 | A | 1/1980 | Drew et al. |
| 4,195,578 | A | 4/1980 | Benoit et al. |
| 4,195,829 | A | 4/1980 | Reser |
| 4,235,350 | A | 11/1980 | Valentino |
| 4,286,525 | A | 9/1981 | Willmore |
| 4,287,835 | A | 9/1981 | Stratton |
| D261,837 | S | 11/1981 | Sonder et al. |
| 4,357,881 | A | 11/1982 | De Long |
| 4,401,036 | A | 8/1983 | Russo et al. |
| D270,588 | S | 9/1983 | Kemple |
| 4,404,698 | A | 9/1983 | Koncelik et al. |
| D270,787 | S | 10/1983 | Umanoff et al. |
| D270,788 | S | 10/1983 | Umanoff et al. |
| 4,484,367 | A | 11/1984 | Jenkins |
| 4,488,497 | A | 12/1984 | Bevans |
| 4,504,992 | A | 3/1985 | Herron et al. |
| 4,573,653 | A | 3/1986 | Boettger |
| 4,601,246 | A | 7/1986 | Damico |
| 4,607,577 | A | 8/1986 | Leonardo |
| 4,612,679 | A | 9/1986 | Mitchell |
| 4,612,718 | A | 9/1986 | Golub et al. |
| 4,667,605 | A | 5/1987 | Bastian |
| 4,680,790 | A | 7/1987 | Packard et al. |
| D292,956 | S | 12/1987 | Inoue et al. |
| 4,715,295 | A | 12/1987 | Hartman et al. |
| D295,348 | S | 4/1988 | Muller |
| 4,805,542 | A | 2/1989 | Peterson et al. |
| 4,828,208 | A | 5/1989 | Peterson et al. |
| 4,831,673 | A | 5/1989 | Winckler |
| 4,836,113 | A | 6/1989 | Waddell et al. |
| 4,848,710 | A | 7/1989 | Newman |
| 4,852,500 | A | 8/1989 | Ryburg et al. |
| 4,922,836 | A | 5/1990 | Damico |
| 4,972,781 | A | 11/1990 | Montgomery et al. |
| 4,987,623 | A | 1/1991 | Stryker et al. |
| 4,993,089 | A | 2/1991 | Solomon et al. |
| 4,998,277 | A | 3/1991 | Rioux, Jr. |
| 4,998,700 | A | 3/1991 | McKaig |
| 4,998,939 | A | 3/1991 | Potthast et al. |
| 5,005,230 | A | 4/1991 | Congdon |
| D317,537 | S | 6/1991 | Pino |
| 5,020,172 | A | 6/1991 | Timm |
| 5,022,327 | A | 6/1991 | Solomon |
| 5,022,810 | A | 6/1991 | Sherrow et al. |
| 5,026,017 | A | 6/1991 | Kreuzer |
| 5,038,430 | A | 8/1991 | Bly |
| 5,038,434 | A | 8/1991 | Navarrette |
| 5,040,813 | A | 8/1991 | Cumbie |
| 5,074,516 | A | 12/1991 | Lewis et al. |
| 5,083,334 | A | 1/1992 | Huck et al. |
| 5,083,625 | A | 1/1992 | Bleicher |
| 5,084,925 | A | 2/1992 | Cook |
| 5,097,550 | A | 3/1992 | Marra, Jr. |
| 5,108,063 | A | 4/1992 | Koerber, Sr. et al. |
| 5,112,044 | A | 5/1992 | Dubats |
| 5,129,117 | A | 7/1992 | Celestina et al. |
| 5,129,611 | A | 7/1992 | Grover et al. |
| 5,144,898 | A | 9/1992 | Posly |
| 5,146,632 | A | 9/1992 | Li |
| 5,173,975 | A | 12/1992 | Peterson |
| 5,175,897 | A | 1/1993 | Marra, Jr. |
| 5,187,824 | A | 2/1993 | Stryker |
| 5,191,663 | A | 3/1993 | Holder et al. |
| 5,205,223 | A | 4/1993 | Ball et al. |
| 5,222,132 | A | 6/1993 | Rioux, Jr. |
| 5,235,258 | A | 8/1993 | Schuerch |
| 5,236,162 | A | 8/1993 | Desjardins |
| 5,255,403 | A | 10/1993 | Ortiz |
| 5,257,765 | A | 11/1993 | Halle |
| 5,279,010 | A | 1/1994 | Ferrand et al. |
| 5,287,815 | A | 2/1994 | Gross |
| 5,290,058 | A | 3/1994 | Adams et al. |
| 5,295,649 | A | 3/1994 | Lee |
| 5,314,243 | A | 5/1994 | McDonald et al. |
| 5,323,500 | A | 6/1994 | Roe et al. |
| 5,327,600 | A | 7/1994 | Hoogendoorn |
| 5,335,385 | A | 8/1994 | Brown |
| 5,335,651 | A | 8/1994 | Foster et al. |
| 5,337,682 | A | 8/1994 | Wiseman |
| D350,446 | S | 9/1994 | Sauvage |
| 5,344,169 | A | 9/1994 | Pryor et al. |
| 5,348,324 | A | 9/1994 | Trotta |
| 5,349,710 | A | 9/1994 | Dunn |
| 5,359,741 | A | 11/1994 | Lang |
| 5,365,623 | A | 11/1994 | Springer |
| 5,365,862 | A | 11/1994 | Peterson |
| 5,370,246 | A | 12/1994 | Traynor |
| 5,374,019 | A | 12/1994 | Fischer |
| 5,381,571 | A | 1/1995 | Gabhart |
| 5,384,927 | A | 1/1995 | Mardero et al. |
| 5,408,940 | A | 4/1995 | Winchell |
| 5,416,839 | A | 5/1995 | Lee |
| 5,418,988 | A | 5/1995 | Iura |
| 5,437,067 | A | 8/1995 | Bernstein et al. |
| 5,438,939 | A | 8/1995 | Clarke |
| 5,461,673 | A | 10/1995 | Coons |
| 5,473,997 | A | 12/1995 | Solomon et al. |
| 5,476,241 | A | 12/1995 | Helman |
| 5,481,772 | A | 1/1996 | Glynn et al. |
| 5,497,766 | A | 3/1996 | Foster et al. |
| 5,511,674 | A | 4/1996 | Boyd et al. |
| D370,135 | S | 5/1996 | Meiners |
| 5,516,244 | A | 5/1996 | Baka |
| D370,795 | S | 6/1996 | Skov et al. |
| 5,524,304 | A | 6/1996 | Shutes |
| D372,818 | S | 8/1996 | Snell |
| 5,542,136 | A | 8/1996 | Tappel |
| 5,544,649 | A | 8/1996 | David et al. |
| 5,544,745 | A | 8/1996 | Famorca |
| 5,551,105 | A | 9/1996 | Short |
| 5,562,049 | A | 10/1996 | Hoffman et al. |
| 5,568,773 | A | 10/1996 | Hung |
| D375,641 | S | 11/1996 | Dhanapal et al. |
| 5,577,277 | A | 11/1996 | Sundberg et al. |
| 5,604,942 | A | 2/1997 | Allevato et al. |
| 5,606,917 | A | 3/1997 | Cauffiel |
| 5,623,948 | A | 4/1997 | Van Morris |
| 5,651,152 | A | 7/1997 | Ritchie et al. |
| D382,428 | S | 8/1997 | Meier et al. |
| D382,746 | S | 8/1997 | Meier et al. |
| 5,655,776 | A | 8/1997 | Kaulfuerst |

5,671,490 A 9/1997 Wu
5,689,839 A 11/1997 Laganiere et al.
5,697,686 A 12/1997 Miller et al.
5,699,564 A 12/1997 Heh
D389,917 S 1/1998 Hornback et al.
5,715,548 A 2/1998 Weismiller et al.
5,732,423 A 3/1998 Weismiller et al.
5,737,781 A 4/1998 Votel
5,742,959 A 4/1998 Froelich
5,746,334 A 5/1998 Brandenberg
5,749,112 A 5/1998 Metzler
5,749,437 A 5/1998 Weller
5,758,374 A 6/1998 Ronci
5,758,972 A 6/1998 Mack et al.
5,775,234 A 7/1998 Solomon et al.
5,777,210 A 7/1998 Voelker et al.
5,779,206 A 7/1998 Harris et al.
5,781,945 A 7/1998 Scherer et al.
5,784,732 A 7/1998 Vail
5,787,530 A 8/1998 Brix
5,789,665 A 8/1998 Voelker et al.
5,802,636 A 9/1998 Corbin et al.
5,802,640 A 9/1998 Ferrand et al.
D402,543 S 12/1998 Thieman
5,842,238 A 12/1998 Herrick et al.
5,857,685 A 1/1999 Phillips et al.
5,863,055 A 1/1999 Kasravi et al.
5,868,079 A * 2/1999 Charny ..... 108/7
5,878,452 A 3/1999 Brooke et al.
5,887,940 A 3/1999 Anderson et al.
5,889,568 A 3/1999 Seraphim et al.
5,890,605 A 4/1999 Percudani
5,894,805 A 4/1999 Raasch et al.
5,898,964 A 5/1999 Stanley
5,906,016 A 5/1999 Ferrand et al.
5,906,017 A 5/1999 Ferrand et al.
5,926,870 A 7/1999 Branca-Barnes et al.
6,006,376 A 12/1999 Williamson
6,008,598 A 12/1999 Luff et al.
D418,997 S 1/2000 Leveen et al.
6,021,533 A 2/2000 Ellis et al.
6,041,930 A 3/2000 Cockburn
6,062,148 A 5/2000 Hodge et al.
6,073,284 A 6/2000 Borders
6,073,285 A 6/2000 Ambach et al.
D427,465 S 7/2000 Thom et al.
6,116,419 A 9/2000 Campagna et al.
6,134,731 A 10/2000 Thom et al.
6,137,404 A 10/2000 O'Connor
6,138,305 A 10/2000 Smith
6,148,459 A 11/2000 Verhulst
6,163,903 A 12/2000 Weismiller et al.
D436,031 S 1/2001 Castaldo
D436,474 S 1/2001 Morren
6,167,580 B1 1/2001 Draheim et al.
6,168,250 B1 1/2001 Rogov
6,170,410 B1 1/2001 Gioacchini et al.
6,182,310 B1 2/2001 Weismiller et al.
6,185,767 B1 2/2001 Brooke et al.
6,192,535 B1 2/2001 Warner, Jr. et al.
6,195,820 B1 3/2001 Heimbrock et al.
6,208,250 B1 3/2001 Dixon et al.
6,224,026 B1 5/2001 Dubois
6,228,385 B1 5/2001 Shick
6,237,507 B1 5/2001 Yanagisawa et al.
6,240,856 B1 6/2001 Paskey et al.
6,253,397 B1 7/2001 Bartow et al.
6,253,399 B1 7/2001 Wagner
6,269,753 B1 8/2001 Roddan
6,286,440 B1 9/2001 Jyringi
6,320,510 B2 11/2001 Menkedick et al.
6,336,235 B1 1/2002 Ruehl
6,336,555 B1 1/2002 Breeden
6,347,419 B1 2/2002 Kurtz
6,347,440 B1 2/2002 Duval et al.
6,360,385 B1 3/2002 Lewandowski
6,374,437 B1 4/2002 Voelker
6,374,752 B1 * 4/2002 Walser ..... 108/50.01
6,390,213 B1 5/2002 Bleicher
6,401,277 B1 6/2002 Savage et al.
6,405,393 B2 6/2002 Megown
6,427,264 B1 8/2002 Metz et al.
6,438,776 B2 8/2002 Ferrand et al.
D463,179 S 9/2002 Brooke
6,450,337 B1 9/2002 Campagna et al.
6,453,491 B1 9/2002 Wells et al.
6,471,311 B1 10/2002 Snyder
6,473,921 B2 11/2002 Brooke et al.
6,481,030 B2 11/2002 Bravo et al.
6,481,688 B1 11/2002 Welling et al.
6,486,792 B1 11/2002 Moster et al.
D467,754 S 12/2002 Chen
6,519,794 B1 2/2003 Aarestad et al.
D471,706 S 3/2003 Campagna et al.
6,543,369 B1 4/2003 Swensson et al.
6,564,404 B1 5/2003 Nanahara
6,575,213 B1 6/2003 Houk
6,601,674 B2 8/2003 Murray
6,601,860 B2 8/2003 Potter
D479,070 S 9/2003 Goodwin et al.
6,615,744 B1 9/2003 Eckstein et al.
6,622,364 B2 9/2003 Hamilton et al.
6,622,980 B2 9/2003 Boucher et al.
6,640,361 B2 11/2003 Heimbrock et al.
6,658,680 B2 12/2003 Osborne et al.
6,678,907 B1 1/2004 Voelker et al.
6,684,420 B2 2/2004 Koenig et al.
6,688,634 B2 2/2004 Noffsinger
6,691,345 B2 2/2004 Nanahara
6,708,991 B1 3/2004 Ortlieb
D488,941 S 4/2004 Lemire et al.
6,721,975 B1 4/2004 Lemire
6,728,982 B2 5/2004 Lemire et al.
6,728,984 B2 5/2004 Dietrich
6,729,502 B2 5/2004 Lewis et al.
6,769,143 B2 8/2004 Clarke
6,795,988 B2 9/2004 Hueppe
6,796,536 B1 9/2004 Sevier, IV
6,799,340 B2 10/2004 Schatz
6,802,093 B1 10/2004 Pope-Brown
6,829,793 B2 12/2004 Brooke et al.
6,832,560 B2 12/2004 Seiler et al.
6,851,142 B2 2/2005 Stryker et al.
6,854,139 B2 2/2005 Lamy
6,877,442 B2 4/2005 Helle
6,915,913 B2 7/2005 Cardinell
6,925,944 B1 8/2005 Miller et al.
6,928,673 B2 8/2005 Risk, Jr.
6,938,289 B2 9/2005 Morin
6,941,598 B2 9/2005 Ferrand et al.
6,942,130 B1 9/2005 Duva
6,952,849 B2 10/2005 Pacella
6,957,461 B2 10/2005 Osborne et al.
6,994,050 B2 2/2006 Johnson et al.
D518,267 S 3/2006 Arceta
7,007,323 B2 3/2006 Zerhusen et al.
7,013,508 B2 3/2006 Wu
7,017,208 B2 3/2006 Weismiller et al.
7,024,708 B2 4/2006 Tomas et al.
7,028,353 B2 4/2006 Waldman et al.
7,032,422 B2 4/2006 George et al.
7,032,522 B2 4/2006 George et al.
7,043,810 B2 5/2006 Bober
D522,750 S 6/2006 Girod
7,073,220 B2 7/2006 Simmonds et al.
7,082,882 B2 8/2006 Heimbrock
7,093,311 B2 8/2006 Gnoyke
7,103,928 B1 9/2006 Childs
7,121,409 B1 10/2006 Hamilton et al.
7,165,687 B1 1/2007 Stevens et al.
7,171,708 B2 2/2007 Osborne et al.
7,200,882 B2 4/2007 Heimbrock
7,200,968 B2 4/2007 Jaworski
D543,722 S 6/2007 Cookson
7,231,678 B2 6/2007 Parker
7,237,286 B1 7/2007 Kim
7,237,287 B2 7/2007 Weismiller et al.
7,257,850 B1 8/2007 Tekulve

| | | | |
|---|---|---|---|
| D552,340 | S | 10/2007 | Graves et al. |
| D552,366 | S | 10/2007 | Graves et al. |
| D555,350 | S | 11/2007 | Graves et al. |
| 7,293,645 | B2 | 11/2007 | Harper et al. |
| 7,296,312 | B2 | 11/2007 | Menkedick et al. |
| D559,043 | S | 1/2008 | Peota et al. |
| 7,314,010 | B2 | 1/2008 | George et al. |
| 7,325,264 | B2 | 2/2008 | Holmes |
| D566,249 | S | 4/2008 | Graves et al. |
| D566,250 | S | 4/2008 | Graves et al. |
| D567,915 | S | 4/2008 | Graves et al. |
| 7,364,184 | B2 | 4/2008 | Delhotal |
| 7,398,951 | B1 | 7/2008 | Sugalski et al. |
| 7,406,731 | B2 | 8/2008 | Menkedick et al. |
| 7,407,177 | B2 | 8/2008 | Darling, III |
| 7,426,759 | B2 | 9/2008 | Donaldson |
| 7,430,771 | B2 | 10/2008 | Heimbrock |
| 7,438,194 | B2 | 10/2008 | Wang |
| 7,444,696 | B2 | 11/2008 | Lin et al. |
| 7,454,804 | B2 | 11/2008 | Macari et al. |
| 7,454,805 | B2 | 11/2008 | Osborne et al. |
| 7,458,114 | B2 | 12/2008 | Troutman |
| 7,461,420 | B2 | 12/2008 | Kim |
| 7,464,425 | B2 | 12/2008 | Chambers et al. |
| D588,829 | S * | 3/2009 | Rheault et al. ..... D6/406.1 |
| 7,497,351 | B2 | 3/2009 | Amundson et al. |
| 7,506,390 | B2 | 3/2009 | Dixon et al. |
| 7,520,006 | B2 | 4/2009 | Menkedick et al. |
| 7,523,515 | B2 | 4/2009 | Allen et al. |
| 7,523,900 | B1 | 4/2009 | Hlatky |
| 7,526,822 | B2 | 5/2009 | Joyce |
| 7,533,429 | B2 | 5/2009 | Menkedick et al. |
| 7,540,243 | B2 | 6/2009 | George et al. |
| 7,559,101 | B2 | 7/2009 | Vrzalik et al. |
| 7,559,102 | B1 | 7/2009 | Benzo et al. |
| 7,581,269 | B2 | 9/2009 | Chen et al. |
| 7,610,637 | B2 | 11/2009 | Menkedick et al. |
| 7,610,638 | B2 | 11/2009 | Kramer et al. |
| 2001/0011393 | A1 | 8/2001 | Brooke et al. |
| 2001/0027578 | A1 | 10/2001 | Brooke et al. |
| 2001/0029628 | A1 | 10/2001 | Ferrand et al. |
| 2001/0032362 | A1 | 10/2001 | Welling et al. |
| 2002/0002742 | A1 | 1/2002 | Osborne et al. |
| 2002/0059679 | A1 | 5/2002 | Weismiller et al. |
| 2002/0061225 | A1 | 5/2002 | Boucher et al. |
| 2002/0066142 | A1 | 6/2002 | Osborne et al. |
| 2002/0080037 | A1 | 6/2002 | Dixon et al. |
| 2002/0095728 | A1 | 7/2002 | Weismiller |
| 2002/0144348 | A1 | 10/2002 | Ganance |
| 2002/0157180 | A1 | 10/2002 | Koenig et al. |
| 2003/0009952 | A1 | 1/2003 | Gallant et al. |
| 2003/0019038 | A1 | 1/2003 | Welling et al. |
| 2003/0037372 | A1 | 2/2003 | Andriunas et al. |
| 2003/0051291 | A1 | 3/2003 | Brooke et al. |
| 2003/0051292 | A1 | 3/2003 | Ferrand et al. |
| 2003/0056293 | A1 | 3/2003 | Brooke et al. |
| 2003/0080014 | A1 | 5/2003 | Ridgeway et al. |
| 2003/0093862 | A1 | 5/2003 | Hanson et al. |
| 2003/0112147 | A1 | 6/2003 | George et al. |
| 2003/0167568 | A1 | 9/2003 | Brooke |
| 2004/0000010 | A1 | 1/2004 | Zerhusen et al. |
| 2004/0060111 | A1 | 4/2004 | Alverson |
| 2004/0064885 | A1 | 4/2004 | Moster et al. |
| 2004/0128760 | A1 | 7/2004 | Schatz |
| 2004/0139546 | A1 | 7/2004 | Ferrand et al. |
| 2004/0148698 | A1 | 8/2004 | Snyder et al. |
| 2004/0148705 | A1 | 8/2004 | Stryker et al. |
| 2004/0158923 | A1 | 8/2004 | Perez et al. |
| 2004/0163177 | A1 | 8/2004 | Stryker et al. |
| 2004/0163574 | A1 * | 8/2004 | Schoenbach et al. ..... 108/50.01 |
| 2004/0177443 | A1 | 9/2004 | Simmonds et al. |
| 2004/0177445 | A1 | 9/2004 | Osborne et al. |
| 2004/0187212 | A1 | 9/2004 | Pacella |
| 2004/0207244 | A1 | 10/2004 | McKellar |
| 2005/0017468 | A1 | 1/2005 | Gallant et al. |
| 2005/0034637 | A1 | 2/2005 | Heimbrock |
| 2005/0125899 | A1 | 6/2005 | Hanson et al. |
| 2005/0132935 | A1 | 6/2005 | Lahmann et al. |
| 2005/0160527 | A1 | 7/2005 | Morin |
| 2005/0229311 | A1 | 10/2005 | Brooke et al. |
| 2006/0026759 | A1 | 2/2006 | Flannery et al. |
| 2006/0031995 | A1 | 2/2006 | Barkhouse |
| 2006/0037140 | A1 | 2/2006 | Clute |
| 2006/0038097 | A1 | 2/2006 | Diller |
| 2006/0053554 | A1 | 3/2006 | Acton |
| 2006/0059621 | A1 | 3/2006 | Poulos et al. |
| 2006/0080776 | A1 | 4/2006 | Clapper et al. |
| 2006/0085612 | A1 | 4/2006 | Nakano et al. |
| 2006/0090259 | A1 | 5/2006 | Castonguay et al. |
| 2006/0090260 | A1 | 5/2006 | Stryker et al. |
| 2006/0101578 | A1 | 5/2006 | Shalikar |
| 2006/0107460 | A1 | 5/2006 | Wiggins et al. |
| 2006/0117481 | A1 | 6/2006 | Stryker et al. |
| 2006/0130237 | A1 | 6/2006 | Clapper et al. |
| 2006/0150332 | A1 | 7/2006 | Weismiller et al. |
| 2006/0170173 | A1 | 8/2006 | Darling, III |
| 2006/0172269 | A1 | 8/2006 | Langone et al. |
| 2006/0179569 | A1 | 8/2006 | Vrzalik et al. |
| 2006/0180054 | A1 | 8/2006 | George et al. |
| 2006/0191072 | A1 | 8/2006 | Hempker et al. |
| 2006/0195984 | A1 | 9/2006 | HakamiuN et al. |
| 2006/0225204 | A1 | 10/2006 | Bretschger et al. |
| 2006/0225205 | A1 | 10/2006 | Troutman |
| 2006/0261569 | A1 | 11/2006 | Delhotal |
| 2006/0283727 | A1 | 12/2006 | Nelson et al. |
| 2007/0069093 | A1 | 3/2007 | Graham et al. |
| 2007/0101498 | A1 | 5/2007 | Voelker |
| 2007/0151027 | A1 | 7/2007 | Hensley et al. |
| 2007/0151032 | A1 | 7/2007 | Heavrin |
| 2007/0166188 | A1 | 7/2007 | Ryterski et al. |
| 2007/0169266 | A1 | 7/2007 | Kim |
| 2007/0174964 | A1 | 8/2007 | Lemire et al. |
| 2007/0180616 | A1 | 8/2007 | Newkirk et al. |
| 2007/0192958 | A1 | 8/2007 | Heimbrock |
| 2007/0194801 | A1 | 8/2007 | Hedges et al. |
| 2007/0216267 | A1 | 9/2007 | Johanning |
| 2007/0240263 | A1 | 10/2007 | Kang |
| 2007/0251009 | A1 | 11/2007 | Kim |
| 2008/0010745 | A1 | 1/2008 | Giesser |
| 2008/0087202 | A1 | 4/2008 | George et al. |
| 2008/0098530 | A1 | 5/2008 | Chen et al. |
| 2008/0111039 | A1 | 5/2008 | Papendieck et al. |
| 2008/0111042 | A1 | 5/2008 | Papendieck et al. |
| 2008/0121150 | A1 | 5/2008 | Picchio |
| 2008/0201844 | A1 | 8/2008 | Gemeline et al. |
| 2008/0209631 | A1 | 9/2008 | Thomas et al. |
| 2008/0209633 | A1 | 9/2008 | Ito et al. |
| 2008/0250562 | A1 | 10/2008 | Tekulve |
| 2008/0289107 | A1 | 11/2008 | Vrzalik |
| 2008/0309051 | A1 | 12/2008 | Elflein |
| 2009/0007332 | A1 | 1/2009 | Wu et al. |
| 2009/0007333 | A1 | 1/2009 | Guguin et al. |
| 2009/0007334 | A1 | 1/2009 | Stryker et al. |
| 2009/0013465 | A1 | 1/2009 | Guguin |
| 2009/0229050 | A1 | 9/2009 | Heimbrock |
| 2009/0236254 | A1 | 9/2009 | Jenkins et al. |
| 2009/0260159 | A1 | 10/2009 | Buchanan |
| 2009/0307843 | A1 | 12/2009 | Hookway et al. |

FOREIGN PATENT DOCUMENTS

| | | | |
|---|---|---|---|
| DE | 37 02 450 | C1 | 5/1988 |
| DE | 40 15 185 | C1 | 6/1991 |
| DE | 40 32 105 | A1 | 4/1992 |
| DE | 195 40 055 | C1 | 6/1996 |
| DE | 195 40 056 | C1 | 6/1996 |
| DE | 200 11 094 | U1 | 12/2000 |
| DE | 199 36 638 | A1 | 2/2001 |
| DE | 20 2005 018 016 | U1 | 5/2006 |
| DE | 20 2008 001 887 | U1 | 5/2008 |
| EP | 0 399 098 | A1 | 11/1990 |
| EP | 0 934 714 | A1 | 8/1999 |
| EP | 0 979 627 | A2 | 2/2000 |
| EP | 1 020 171 | A1 | 7/2000 |
| EP | 1 092 369 | A1 | 4/2001 |
| EP | 1 645 208 | A1 | 4/2006 |
| WO | WO 94/13198 | | 6/1994 |

| | | | |
|---|---|---|---|
| WO | WO 98/02107 | | 1/1998 |
| WO | WO 03/013307 | A1 | 2/2003 |
| WO | WO 2004/098351 | A1 | 11/2004 |

OTHER PUBLICATIONS

Hill-Rom Sales Brochure "The P633 Overbed Table," Nov. 1996.

Hill-Rom Brochure—"Overbed Tables," 2000, (2 pages).

International Preliminary Report and Written Opinion for PCT/US2009/047202, dated Jul. 29, 2009, (11 pages).

* cited by examiner

ITEM SUPPORT APPARATUSES AND SYSTEMS FOR BEDSIDE

This application claims priority under 35 U.S.C. §119(e) to U.S. Provisional Patent Application Ser. No. 61/061,420, filed Jun. 13, 2008 entitled ITEM SUPPORT APPARATUSES AND SYSTEMS FOR BEDSIDE, the entirety of which is hereby incorporated by reference herein.

FIELD

The present disclosure relates to item support apparatuses usable with a patient support, and in particular, in one illustrative embodiment to an overbed table for extending over a bed and/or stretcher.

BACKGROUND

Tables are used adjacent beds in hospitals, longterm care facilities, nursing homes, and bedrooms. Such tables are used for the convenience of the caregiver in the room, and/or the patient or individual lying on the patient support surface. Overbed tables, for example, have a surface which is positionable over the patient support surface and usable by the patient.

However, some tables can sometimes be difficult to operate. Moreover, some tables can be difficult to place adjacent and use with certain beds and/or stretchers. Additionally, some tables can have very limited capacity for storage or for placement of certain items. Moreover, such tables can sometimes take up considerable room, yet be very limited in their functionality, ease of use, and convenience, as well as where they can be placed and with which beds and/or stretchers they may be used.

Increased hand cleaning and sanitizing can help significantly reduce the spread of disease and infection. Soap and sanitizing substances may be available in hospital hallways, restrooms, and bedrooms. However, such materials are often not conveniently accessible, especially by individuals whose mobility is limited.

There is a persistent need for further contributions and improvements in these areas of technology.

SUMMARY

According to one aspect of the present disclosure, an item support apparatus, such as an overbed table, is provided including a support surface assembly configured for placement of items, and a hand sanitizer container housing coupled with the support surface assembly and configured to receive a removable hand sanitizer container unit.

In another aspect of the present disclosure, a system for cleaning is provided comprising a support surface assembly configured to be positionable over a patient support apparatus (e.g., a bed or stretcher) and coupled to a container receptacle. The system includes a removable container sized and/or configured to engage the container receptacle, and containing a cleaning material. The cleaning material may be a hand sanitizer and the engagement may occur via interference fitting or via snap-in fitting, for example. The container may be disposable in some embodiments.

According to another aspect of the present disclosure, an item support apparatus, such as an overbed table, is provided comprising a support surface for holding a patient item and a transport mechanism configured to assist in moving the surface across a floor. The apparatus further includes a locking mechanism configured to frictionally engage the transport member to resist movement of the transport member upon a weight of a predetermined amount being placed on the support surface.

In still another aspect of the present disclosure, an item support apparatus, such as an overbed table, is provided comprising a support surface assembly configured to be positionable over a patient support apparatus, and a stationary side assembly positionable adjacent a vertical support that raises/lowers the support surface assembly. The vertical support is adjustable in height, which allows for adjustment of the height of the support surface assembly with respect to the stationary side assembly.

In yet another aspect of the present disclosure, an item support apparatus, such as an overbed table, is provided comprising a support surface assembly configured to be positionable over a patient support apparatus and having a pair of movable table top sections. The sections are movable in first and second directions. The apparatus further comprises a locking mechanism configured to prevent movement of the first and second movable table tops in the same direction at the same time. In this embodiment, either top can deploy in either direction but not in the same direction at the same time.

According to another aspect of the present disclosure, an item support apparatus, such as an overbed table, is provided comprising a support surface assembly configured to be positionable over a patient support apparatus. The support surface assembly includes at least one human interface portion configured to be contacted by the user for operation of the apparatus. The at least one human interface portion comprises an antimicrobial agent, such as metal particles, for example.

In yet another aspect of the present disclosure, an item support apparatus, such as an overbed table, is provided comprising a support surface assembly configured for placement of an item and configured to be positionable over a patient support apparatus. The support surface assembly includes at least one human interface portion configured to be contacted by the user for operation of the apparatus. The at least one human interface portion includes a visual indicator identifying it as the interface portion. The visual indicator may be differing colors or raised letters such as Braille lettering, or combinations thereof, for example.

In still another aspect of the present disclosure, an item support apparatus, such as an overbed table, is provided comprising a support surface assembly configured for placement of an item and configured to be positionable over a patient support apparatus. A compartment is provided which houses a mirror. The mirror can be attached to a swivel mechanism which permits multiple degrees of freedom of movement, as well as rotation of the mirror into and out of the housing.

According to another aspect of the present disclosure, an overbed table includes a base assembly, a vertical support column coupled to the base assembly and configured to move upwardly and downwardly relative to the base assembly, and a support surface assembly coupled to the vertical support column and configured for placement of items thereon. The overbed table further includes a side assembly coupled to the base assembly and positioned adjacent the support surface assembly. The support surface assembly is configured to move upwardly and downwardly with the vertical support column relative to both the base and the side assembly.

In one illustrative embodiment, the side assembly may include a side support surface and a storage bin coupled to the side support surface. In another illustrative embodiment, substantially all of the weight of the side assembly may be supported by the base assembly. In still another illustrative embodiment, the side assembly may also include a side surface and a support post coupled to and extending between the side surface and the base assembly. Illustratively, the support post may be parallel with and spaced-apart from the vertical support column. Further illustratively, the side assembly may be configured to remain vertically stationary relative to the base when the support surface assembly moves upwardly and downwardly.

In another illustrative embodiment, the support surface assembly may include a table top configured for placement of items thereon, a first storage section coupled to the table top and positioned adjacent a proximal end of the table top, and a second storage section coupled to the table top and positioned adjacent a distal end of the table top. Illustratively, the first storage section may include a plurality of open storage receptacle formed therein and the second storage section may include a cup holder and a container. Further illustratively, the support surface assembly may include another table top such that each of the table tops are movable relative to each other and relative to the first and second storage sections.

In still another illustrative embodiment, the base assembly may be generally U-shaped to define a first elongated foot and a second elongated foot spaced-apart from the first elongated foot. Illustratively, the distal end of each of the first and second elongated feet may be spaced farther apart than the proximal end of each of the first and second elongated feet.

According to another aspect of the present disclosure, an overbed table includes a base assembly, a vertical support column coupled to the base assembly and configured to move upwardly and downwardly relative to the base assembly, and a support surface assembly coupled to the vertical support column and configured to move upwardly and downwardly with the vertical support column relative to the base assembly. The support surface assembly includes a table top configured for placement of items thereon, a first storage section positioned adjacent a proximal end of the table top, and a second storage section positioned adjacent a distal end of the table top.

In one illustrative embodiment, the second storage section may include a cup holder and the first storage container may include a recessed portion configured to receive a hand sanitizer container unit therein. Illustratively, the first storage section may also include a locking portion configured to lock the container within the recessed portion.

In another illustrative embodiment, the items support apparatus may also include a side assembly positioned adjacent the vertical support column such that the first storage section is positioned between the side assembly and the table top.

In still another illustrative embodiment, the support surface assembly may include at least one human interface portion comprising an antimicrobial agent. The human interface portion may include at least one of a handle, lever, button, latch, and grip portion, and the antimicrobial agent may include at least one of a metal and metal compound.

In yet another illustrative embodiment, the base assembly may include at least one wheel and at least one locking mechanism configured to lock the wheel upon a weight of a predetermined amount being placed on the support surface assembly. Illustratively, the locking mechanism may be configured to frictionally engage at least two sides of the wheel to resist movement of the wheel upon the weight of the predetermined amount being placed on the support surface assembly.

In another illustrative embodiment, one of the first and second storage sections may include a mirror movable from a stowed position to a use position. Further illustratively, the support surface assembly may include another table top section and a locking mechanism configured to prevent the table top sections from being moved in the same direction. Illustratively, the locking mechanism may include a generally triangular member pivotably coupled to a platform of the support surface assembly.

In still another illustrative embodiment, the support surface assembly may include at least one human interface portion configured to be contacted by the user for operation of the apparatus. Illustratively, the at least one human interface portion may includes a visual indicator identifying it as the human interface portion. Further illustratively, the visual indicator may include raised lettering and/or Braille lettering.

In another illustrative embodiment, the support surface assembly may include a hand sanitizer container housing configured to receive a removable hand sanitizer container unit therein. Illustratively, the housing may include a slot formed integrally with one of the first and second storage sections and may be configured to receive the hand sanitizer container unit therein. Further illustratively, the housing may include at least one side wall configured to abut the hand sanitizer container unit. Alternatively, the housing may be sized to frictionally hold the unit therein. The housing may also includes a locking portion configured to lock the unit within the housing.

According to another aspect of the present disclosure, an overbed table includes a base assembly configured for placement of a support surface adjacent a patient support apparatus. The support surface assembly is coupled to the base assembly and the support surface assembly is configured to support an item thereon. The support surface assembly is configured to be positionable over the patient support apparatus when the base assembly is adjacent the patient support apparatus. Illustratively, the support surface assembly includes a pair of movable table top sections and a locking mechanism configured to prevent movement of one of the table top sections in a first direction if the other table top section has been moved in the first direction.

In one illustrative embodiment, the locking mechanism may include a pivot mechanism. Further illustratively, the pivot mechanism may includes a generally triangular member pivotably coupled to a platform of the support surface assembly. The platform may be positioned below the pair of movable table top sections. Illustratively, the pivot mechanism may include another generally triangular member pivotably coupled to the platform of the support surface assembly. Each table top section of the pair of table top sections may illustratively be configured to engage one of the generally triangular members of the pivot mechanism when moved in a first or second direction.

In another illustrative embodiment, each table top section of the pair of table top sections may be configured to be movable in a second direction opposite the first direction when the other of the table top sections is moved in the first direction.

According to another aspect of the present disclosure, an overbed table includes a base assembly including a first elongated foot and a second elongated foot spaced-apart from the first elongated foot to define a generally U-shaped base assembly. The distal end of each of the first and second elongated feet is spaced farther apart than the proximal end of the each of the first and second elongated feet. The overbed table further includes a vertical support column coupled to the base assembly and configured to move upwardly and downwardly relative to the base assembly and a support surface assembly coupled to the vertical support column and configured to move upwardly and downwardly with the vertical support column relative to the base assembly. The support surface assembly includes a table top configured for placement of items thereon, a first storage section positioned adjacent a proximal end of the table top and a second storage section positioned adjacent a distal end of the table top. The overbed table further includes a side assembly coupled to the base assembly and positioned adjacent the support surface assembly such that first storage section of the support surface assembly is positioned between the table top and the side assembly. The side assembly is configured to remain vertically stationary relative to the base assembly and includes a side support surface and a support post coupled to and extending between the side support surface and the base assembly.

According to still another aspect of the present disclosure, a siderail system of a patient support apparatus includes a siderail having a siderail opening formed therein and defined by upper and lower rail portions of the siderail. The siderail system further includes a sanitizer container positioned within the siderail opening. The sanitizer container includes a rear wall, a front wall, a top wall engaged with the upper rail portion, a bottom wall engaged with the lower rail portion, and opposite side walls. Further, the sanitizer container is configured to contain a sanitizer substance therein.

In one illustrative embodiment, the sanitizer container may further include a dispenser coupled to the front wall and configured to dispense the sanitizer substance contained within the sanitizer container upon actuation by a user. Illustratively, the dispenser may be one of a spring-loaded lever, a pump, and a push-button.

In another illustrative embodiment, a cross-section of each of the top wall and the bottom wall of the sanitizer container may be U-shaped to define a groove of the each of the top and bottom walls.

In still another illustrative embodiment, the sanitizer container may also include a spring-loaded tab pivotably coupled to the bottom wall of the container. Illustratively, the spring-loaded tab may be biased to an extended position such that the tab extends outwardly from the bottom wall of the container and wherein the spring-loaded tab is movable to a compressed position such that the tab is generally flush with the bottom wall of the container. Further illustratively, the spring-loaded tab may be engaged with the lower rail portion of the siderail.

According to yet another aspect of the present disclosure, an overbed table includes a base assembly, a vertical support column coupled to the base assembly and configured to move upwardly and downwardly relative to the base assembly, and a support surface assembly coupled to the vertical support column and configured for placement of items thereon. The support surface assembly is configured to move upwardly and downwardly with the vertical support column relative to the base. The support surface assembly includes a first storage section positioned adjacent a proximal end of the table top, and a second storage section positioned adjacent a distal end of the table top. The overbed table further includes a sanitizer container positioned within a recessed portion of one of the first and second storage sections. The sanitizer container is configured to contain a sanitizer substance therein. The sanitizer container further includes a dispenser coupled to the front wall and configured to dispense the sanitizer substance contained within the sanitizer container upon actuation by a user.

In one illustrative embodiment, the one of the first and second storage sections including the recessed portion further includes a locking portion configured to lock the sanitizer container within the recessed portion. In another illustrative embodiment, the recessed portion includes a narrower lower portion and the sanitizer container is configured to engage the narrower lower portion in an interface fit.

These and other features, alone or in combination with any other feature(s) (such as those described herein and/or those listed in the claims) may comprise patentable subject matter. Such features and principles of the disclosure will become apparent to those skilled in the art upon consideration of the following detailed description of various examples and embodiments illustrating the best mode of carrying out the features and principles as presently perceived.

DETAILED DESCRIPTION OF ILLUSTRATIVE EMBODIMENTS

Figure 1:
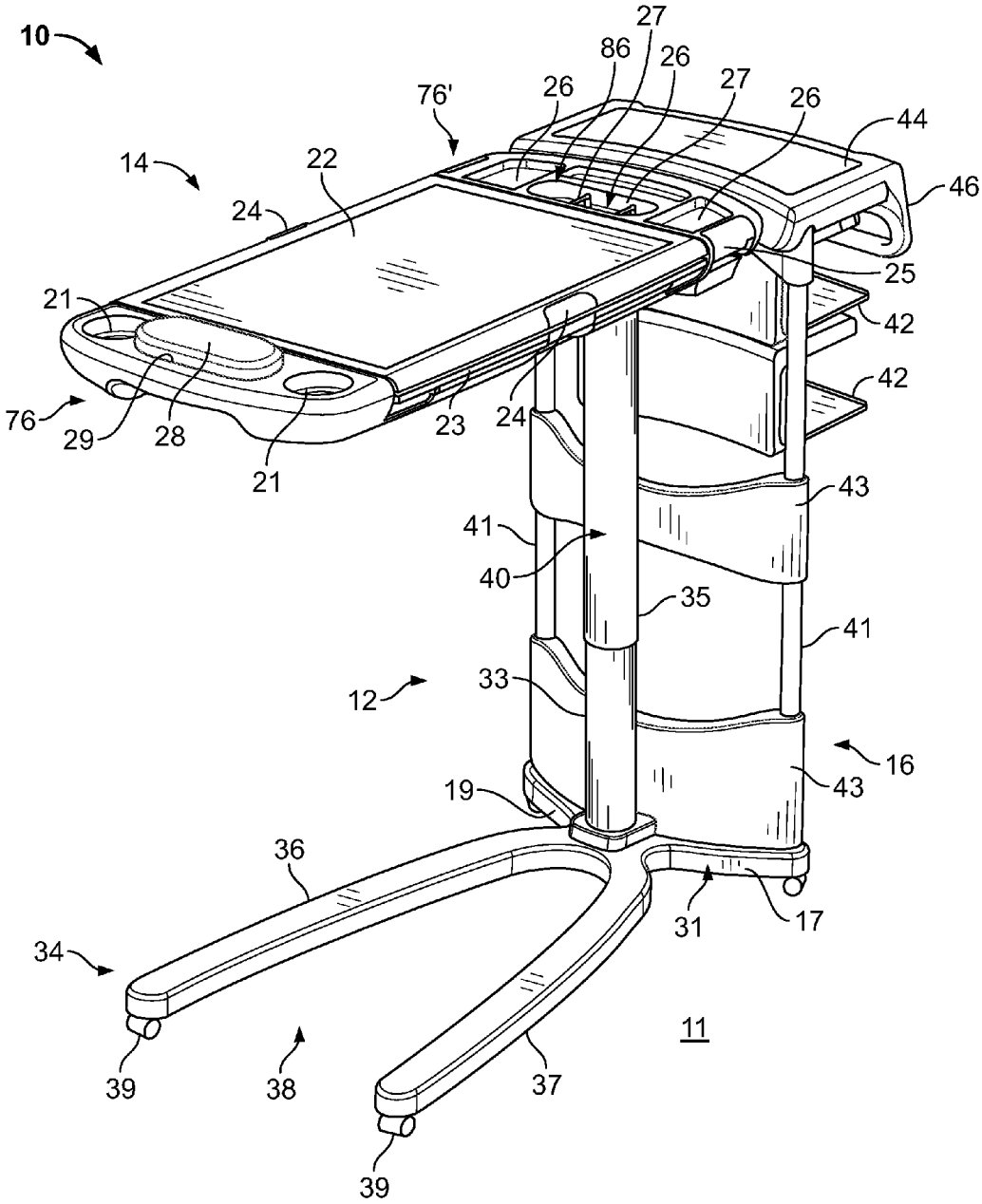
FIG. 1 is a perspective view of an overbed table according to one illustrative embodiment illustrating various principles of the present disclosure, with the support surface assembly shown in the raised position.

In general, improved item support apparatuses, such as patient tables or overbed tables for example, are provided. In one embodiment, a support surface is configured for placement of items for use by the patient, caregiver, or person in bed. A base is coupled with the support surface assembly and configured for placement of the support surface adjacent a patient support apparatus, such as a bed for example. In some embodiments, the support surface assembly includes a container receptacle or housing coupled with the support surface assembly and configured to receive a removable container unit, which may contain hand sanitizer, tissues, wipes, cleaning material, sanitizer, lotion, antibacterial material, or the like, or other personal care item(s). The container and receptacle system may engage or lock together. In some embodiments, the support surface assembly includes a storage portion as part of a side assembly and a table portion, the table portion being movable in height, such as via a column for example, relative to the storage portion. In the same or other embodiments, the support surface assembly may include at least one human interface portion, such as a grip, button, lever, or handle, for operation of the table, and the human interface portion may include an antimicrobial agent, such as antimicrobial metal particles on or within the surface of the human interface portion. In some embodiments, the base may include at least one transport member, such as a wheel for example, and at least one locking mechanism configured to lock the transport member upon a weight of a predetermined amount (e.g., the weight of a person) being placed on the support surface assembly. The support surface in some embodiments may comprise a pair of movable table top sections that are movable in either direction, and a locking mechanism configured to limit the movement of the second section in the same direction as the first section once the first section has been moved in one direction.

Further, a siderail system of the present disclosure is provided as well. In one embodiment, this siderail system includes a siderail and a sanitizer container coupled thereto. Illustratively, the siderail includes an opening and the sanitizer container is received and maintained within the opening of the siderail. The sanitizer container may include a sanitizer substance such as a foam or liquid therein. Alternatively, the sanitizer container may include sanitizer wipes. In another embodiment, the sanitizer container includes a dispenser coupled to a front wall of the container and configured to dispense the sanitizer substance therefrom when actuated by a user. Further illustratively, a spring-loaded tab of the sanitizer container may be provided to maintain the sanitizer container within the opening of the siderail. The spring-loaded tab may be pivotably coupled to the bottom wall of the container.

Turning now to the illustrative examples of the drawings, FIGS. 1-4 show an item support apparatus according to one embodiment which is illustrative of various principles of the present disclosure. In this embodiment, the item support apparatus is in the form of an overbed table 10. Principles of the present disclosure may be used with other tables, shelves, desks, carts, support apparatus, and the like. The table 10 includes a support surface assembly 14 for placement of items, a side assembly 16, and a base assembly 12 that is coupled with and supports the surface assembly 14 and side assembly 16 relative to the floor 11. The table 10 further includes a vertical column 40 coupled to and positioned between the support surface assembly 14 and the base assembly 12 in order to space the support surface assembly 14 from the floor 11. As is discussed in greater detail below, the vertical column 40 includes telescoping components configured to move the support surface assembly 14 upwardly and downwardly relative to the base assembly 12.

The base assembly 12 includes a generally horizontal floor base section 34 for placement near the floor 11. Many other base configurations, including single and multi-section base configurations are possible. In this embodiment, the floor base section 34 includes a pair of feet 36 and 37 arranged in a generally U-shaped configuration and defining a gradually widening space 38 therebetween. The space 38 is configured to receive the caster, support, or other structure of a bed or stretcher or other patient support apparatus, such that the pair of feet 36, 37 partially surround or straddle the structure. Illustratively, a width of the base section 34 (or a distance between the feet 36, 37) increases as one moves along the feet 36, 37 from the proximal end of the feet 36, 37 (i.e., the end of the feet 36, 37 closest the vertical column 40) to the distal end of the feet 36, 37 (i.e., the end of the feet 36, 37 farthest from the vertical column 40). In other words, the distance between the feet 36, 37 varies along the length of the feet 36, 37 such that the distal end of each of the first and second elongated feet 36, 37 is spaced farther apart than the proximal end of each of the first and second elongated feet 36, 37. Because of the varying width of the space 38 (i.e., the distance between the feet 36, 37), the table 10 can engage and be easily used with a variety of different beds and stretchers with a variety of different floor support or caster systems or other lower structures.

As shown in FIGS. 1-4, the base section 34 further includes a side portion 31 including two arms 17, 19 spaced-apart from each other. The side portion 31 is coupled to the feet 36, 37 of the base section 34 and generally extends in a direction away from the feet 36, 37, as shown in FIG. 1. Illustratively, each foot 36, 37 and each arm 17, 19 of the side potion 31 of the base section 34 may include transport mechanisms such as casters or wheels 39 for ease of movement of the system. As is discussed in greater detail below, these transport mechanism may be provided with a weight-activated locking mechanism.

Continuing with the example illustrated in FIGS. 1-4, the vertical support or column 40 rises from the floor base section 34. In this embodiment, the vertical support column 40 comprises a pair of telescoping tube sections 33 and 35 which telescope within and over one another respectively. Accordingly, the raising and lowering of the support surface assembly 14 is enabled by the telescoping tube sections 33 and 35, which may lock to the desired position via a high/low mechanism, as is discussed in greater detail below.

Connected to the top of the vertical support column 40 is the support surface assembly 14 for placement of support of the items. In this example, the support surface assembly 14 includes a first table top 22 and a second table top 23 (shown in FIG. 3), and a pair of side storage sections 76, 76' abutting the ends of the table tops 22, 23. Illustratively, while the support surface assembly includes a storage section 76, 76' coupled to each of the proximal and distal ends of the table tops 22, 23, it is within the scope of this disclosure to include a support surface assembly having a storage section located at only one of the proximal and distal ends of the table tops 22, 23, for example.

The support surface assembly 14 thus can support and store a variety an items, including food, drinks, reading material, documents, computers, devices, charts, and personal items. In particular, the side storage section 76 may include cupholder recesses 21 sized for fitting cups or cans therein. Additionally, the side storage section 76 may include a removable housing or container 28 which fits in a recess or slot 29 in the section 76. As is discussed in greater detail below, the container 28 may include tissues or wipes therein in order to provide the patient with easy access to such wipes. The container 28 may also include a liquid or foam hand sanitizer therein, such as the container 828 shown in FIG. 16, the container 928 shown in FIGS. 17-20, and the container 1028 shown in FIG. 21, and discussed in greater detail below. Of course, the container 28 may include other items as well.

Looking again to FIGS. 1-4, Moreover, the opposite side storage section 76' may include a variety of housings or recesses 21, 26 for storage of items. In this example, a recess 26 comprises an open-top-housing 86 defined by one or more sidewalls 27 rising up from the base of the recess 26. Additional dividers or walls 27 may be located within the recesses 26. As further described in alternative embodiments below, the walls 27 may be sized and configured to substantially match or correspond with that of a dispenser or container, such as the dispenser 560 shown in FIG. 5, so that the dispenser may snap or securely fit within the recess 26 or a portion thereof.

The side assembly 16 is located adjacent the vertical support column 40. The side assembly 16 includes one or more bins 42 for storage of healthcare items, charts, medical devices, or personal items, as well a side assembly table top 44, which may be used by a caregiver for writing notes, placing charts and computers, etc. The side assembly table top 44 includes a handle 46 that may be used to move the table 10 to a desired position. The side assembly 16 further comprises a pair of posts 41 coupled to and rising from the side portion 31 of the base section 34. The posts 41 couple to and support the side assembly table top 44 on the base section 34. Connected to the posts 41 and/or the side assembly table top 44 are the bins 42. Other shelves, pockets and the containers may be connected to the side assembly 16, for storage of items. For example, the side moldings 43, which provide support and protection for the system, can include one or more pockets or compartments.

Illustratively, the weight of the side assembly 16 is carried primarily by the side posts 41 and the base assembly 12. In other words, the vertical support column 40 does not operate to substantially support the weight of the side assembly 16. Rather, the vertical support column 40 operates to support the weight of the support surface assembly 14. As is discussed in greater detail below, the support surface assembly 14 is configured to move upwardly and downwardly with the vertical support column 40 relative to the base assembly 12 and the side assembly 16. The side assembly 16 is configured to remain stationary while the support surface assembly 14 moves upwardly and downwardly relative thereto. Thus, the vertical support column 40 is not required to bear the weight of the side assembly 14 as the vertical support column 40 moves upwardly and downwardly itself, as is discussed in greater detail below. Illustratively, while the side assembly 16 is configured to remain stationary relative to the support surface assembly 14 while the support surface assembly 14 moves upwardly and downwardly, it is within the scope of this disclosure to provide a bracket (not shown) in order to directly coupled the side assembly 16 and the support surface assembly 14 to each other. In such an embodiment, the side assembly 16 would move upwardly and downwardly with the support surface assembly 14 relative to the base assembly 12. Further, the supporting side structure such as the posts 41 would not be necessary and may be removed to allow the side assembly 16 to move with the support surface assembly 14.

Figure 2:
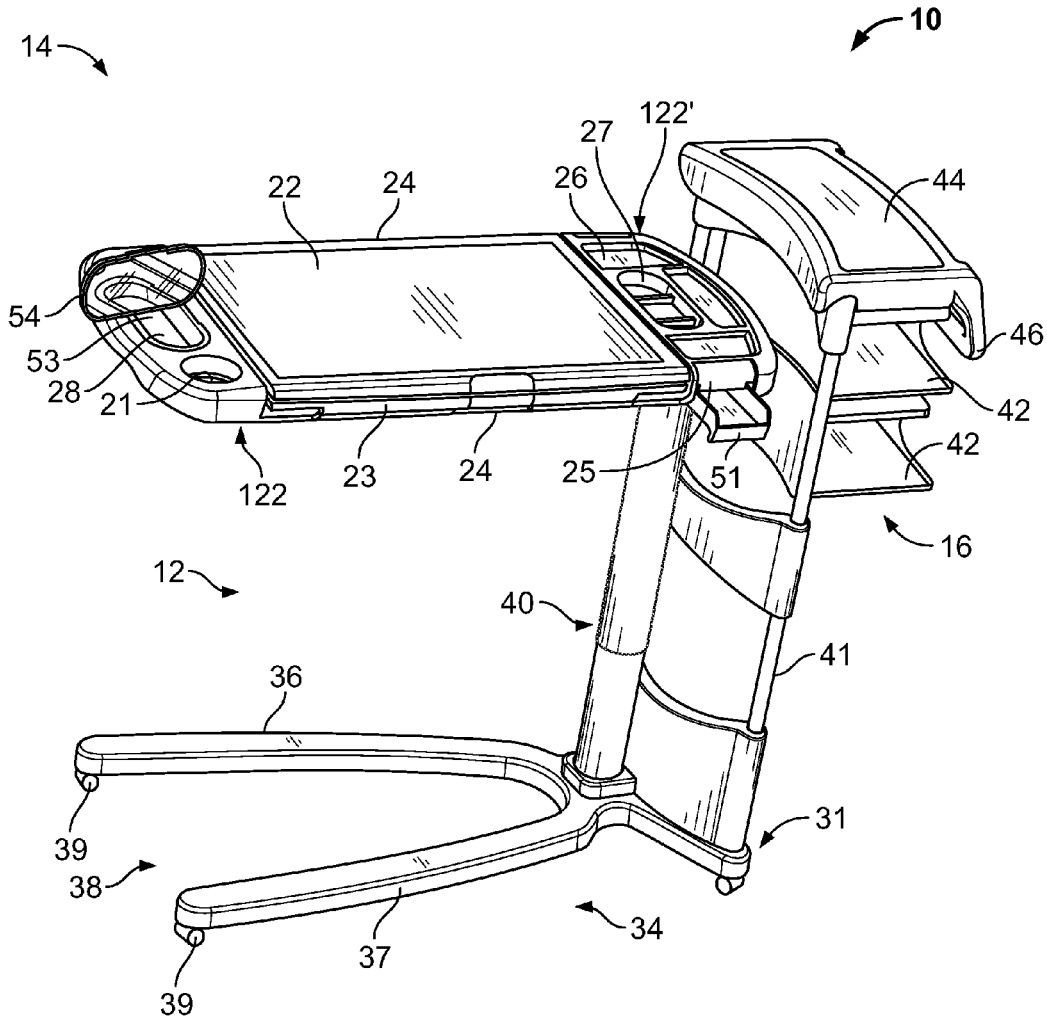
FIG. 2 is a perspective view of the overbed table of the embodiment of FIG. 1, wherein the support surface assembly is shown in an adjusted or lowered position.

As noted above, the table tops 22, 23 and side storage sections 76, 76' of the support surface assembly 14 may be raised and lowered relative to the side assembly 16. FIG. 2 in particular is a top perspective view of the overbed table, wherein part of the support surface assembly 14 is shown in an adjusted, lowered position, for use by a patient whose bed is in a lower position than the standard raised position of the table 10. The side assembly table top 44 remains in the stationary position in this embodiment, such as for use by a caregiver. To actuate the vertical support column 40, a human interface, such as lever 25, may be provided. The user lifts the lever 25 to the unlocked position to free the locking mechanism of the vertical support column 40, allowing for raising and lowering of the column. The lever 25 can then be released, returning to its biased locked position when the vertical support column 40 is at the desired height.

To allow for the raising and lowering, internal to the vertical support column 40 is a locking mechanism which holds firm when the lever 25 is in the locked position and which releases when the lever 25 is in the unlocked position. The mechanism may be adjustable and lock with a mechanical unidirectional locking device at any height between the lowest and highest position. The internal unidirectional locking mechanism may allow the unit table tops 22/23 to rise freely when contacted by an upward vertical force and to lock anywhere along the Hi-Low travel when a vertical downward force is applied. As shown in FIGS. 1-4, the Hi-Low release levers 25 may be located on each patient side of the table, and the levers 25 may be biased to the locked position and activated by applying a force 2 lbs or less, for example. The tops 22/23 may thus be lowered by actuating one of the release levers 25 and applying a downward vertical force evenly distributed over the column end of the table tops (e.g., 20 lbs or less, measured 1 inch from the uppermost position of the column). A gas-spring counter balance (not shown) may be incorporated internal to the support column 40 which has reverse dampening to facilitate a control descent so that a free fall condition does not exist. The counterbalance and unidirectional lock thus may work in conjunction to eliminate free-state "phantom upward movement" at least for some period of time (e.g., 15 seconds or more). As discussed above, the weight of the side assembly 16 is supported mainly by the base assembly 12 and not by the vertical support column 40. Therefore, the counterbalance mechanism does not need to be configured to take into account the weight of the side assembly 16 and/or the weight of any items which may be placed on the side assembly 16. Rather, the counterbalance mechanism need only operate against the weight of the support surface assembly 12. In one embodiment, the support surface assembly 14 is movable between less than 30" in the low position to greater than 40" in the high position (e.g., in a range between about 28 inches and about 46 inches).

Figure 15:
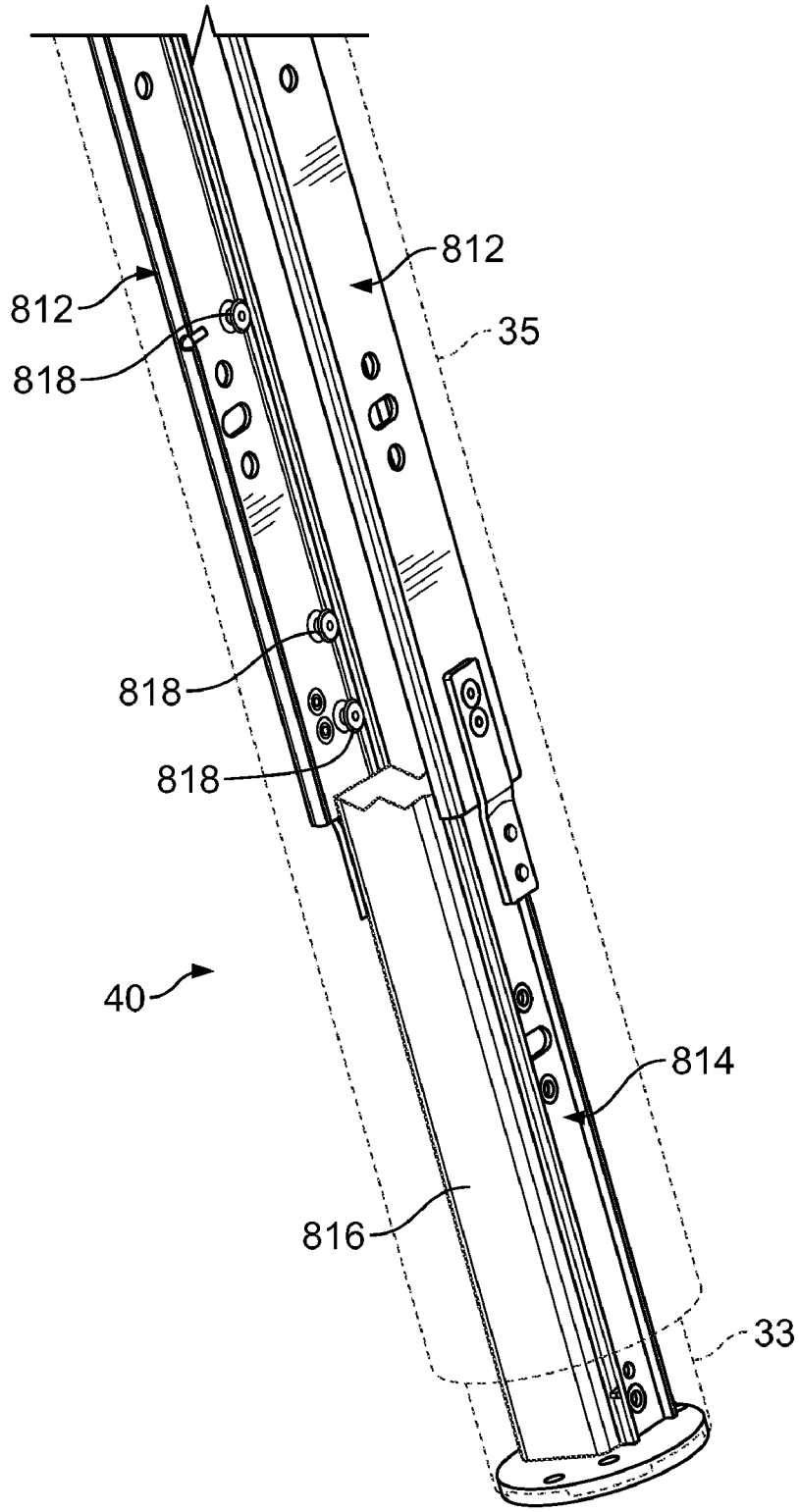
FIG. 15 is a perspective view of a vertical support column of the overbed table of FIGS. 1-4 showing a track system of the column to allow telescoping members of the column to move relative to each other.

Illustratively, the vertical support column 40, including the telescoping tube sections 33 and 35, also includes a track mechanism 800 to allow the telescoping tube sections 33, 35 to slide upwardly and downwardly relative to each other. As shown in FIG. 15, for example, a first, or upper, set of tracks 812 is coupled to the upper tube section 35 and positioned on the inside of the tube section 35. A second, or lower, set of tracks 814 is coupled to the lower tube section 33 and positioned on the inside of the tube section 33. In particular, the vertical support column 40 includes an inner post 816 coupled to the lower tube section 33. The second set of tracks 814 is coupled to the inner post 816. Illustratively, a portion of the second set of tracks 814 is received within respective members of the first set of tracks 812 in order to guide the up and down movement of the upper tube section 35 relative to the lower tube section 33 when the hi/low mechanism is operated by a user in order to adjust the overall height of the support surface assembly 14 relative to the base assembly 12. Sliders or bearings 818 are positioned between the upper and lower track sections 812, 814 in order to allow the tracks 812, 814 to slide easily relative to each other.

Looking again to FIG. 2, the side storage section 76' further includes a sliding drawer 51 which slidingly engages a housing of the side portion 76'. Patient items, such as jewelry, coins, wallets, and other personal items may be stored in the drawer 51. In the example of FIG. 2, the container 28 includes a mirror 54 which is on a swivel joint 53 having at least one degree of rotational freedom and which can be lifted and/or rotated to allow for use by the patient. The container 28 may snap into the recess in the table, using appropriate engagement or locking mechanisms or arrangements, such as one or more of those described herein. Illustratively, while the container 28 (which may include a mirror and/or tissue wipes, as discussed above) is provided to snap into a recess or slot in the support surface assembly 14 of the overbed table 10, it is within the scope of this disclosure to provide containers which are sized and configured to be snapped into slots, spaces, and/or recesses of other hospital or medical equipment as well, such as, but not limited to, the siderail of a patient support apparatus, such as a hospital bed, for example.

Figure 16:
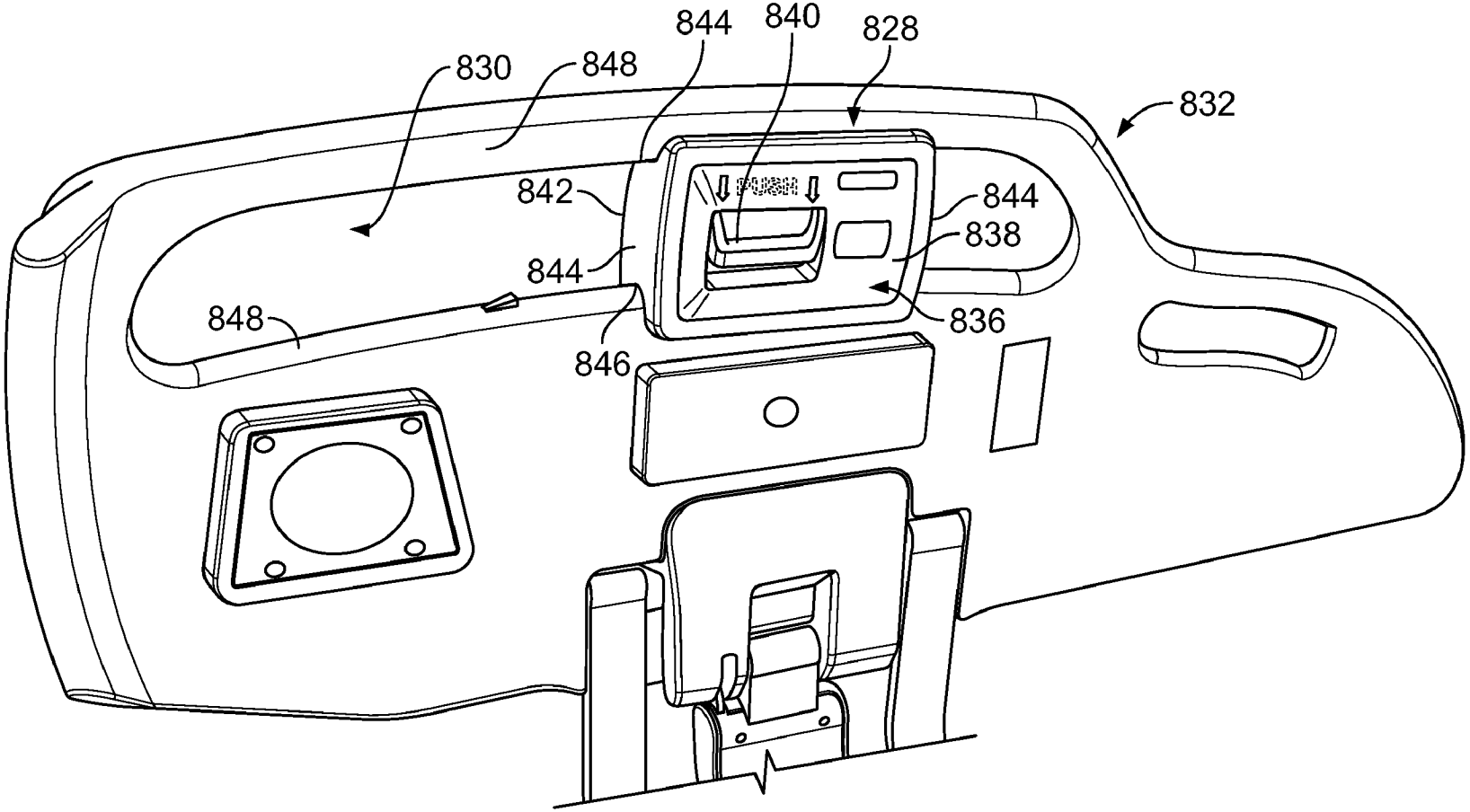
FIG. 16 is a perspective view of a siderail of a hospital bed and a container sized and configured to be positioned within an open space of the siderail.

In particular, as shown in FIG. 16, the container 828 is sized and configured to be positioned within a siderail opening or space 830 of an illustrative siderail 832 of a patient support apparatus such as a hospital bed, stretcher, or the like. (Illustrative siderail 832 could be used in place of one or more of the siderails 240 on the illustrative bed 100 of FIG. 4, and thus the siderail 832 and its bed 100 may operate in the manner described herein with respect to FIG. 4.) The siderail 832 and the container 828 cooperate to define a siderail assembly. As shown in FIG. 16, the container 828 is generally rectangularly-shaped and includes a front wall 836 having a removable lid 838 and a push-down dispenser 840 formed therein, a rear wall 842 spaced-apart from the front wall 836, and four side walls 844 coupled to and extending between the front and rear walls 836, 842. Illustratively, each of the four side walls 844 is curved inwardly or U-shaped in cross-section in order to define a groove 846 therein. In use, the container 828 is press-fit or snapped into the space 830 of the siderail 832 such that the rail portions 848 of the siderail 832 are received within one or more of the grooves 846. As shown in FIG. 16, for example, a top wall 844 of the container 828 is engaged with the upper rail portion 848 of the siderail 832 while a bottom wall 844 of the container 828 is engaged with the lower siderail portion 848 of the siderail 832. Illustratively, the container 828 is configured to house a sanitizer substance such as a foam or liquid sanitizer therein which may be dispensed by the patient or caregiver by activating the dispenser 840. It also should be understood that the container 828 may be configured to contain other items such as wipes, for example, as well. Further, while the container 828 is shown with a spring-loaded push-down lever-type dispense, it should be understood that other dispensers, such as a lever or a push-button, for example, may be used as well.

In such an embodiment, the container 828 can comprise a plastic box that houses antimicrobial wipes and allows the wipes to be accessed via an opening or lid in the box. The box may comprise two inner pieces that are smaller than the opening in the siderail, and which can thereby enter the siderail opening. These two pieces can lock together from opposite sides of the siderail 832, while larger outer portions (which are larger than the opening in the siderail) hold the box 828 in place. Many other alternatives are possible as well. For example, the box 828 could comprise a plastic box with an insert portion generally sized and configured to snugly fit within a portion of the siderail opening, such as via an interference fit where the insert portion is slightly larger than the siderail opening. As is discussed below in regard to FIGS. 17-20, for example, such an interference fit may also be provided by an extendable tab on the container, such as a spring-loaded tab, which is movable inwardly toward the container to allow the container to enter the siderail opening 830 and which is then biased outwardly to provide an outward force on the siderail 832 to allow the container to be held within the opening 830. Other configurations for holding the box 828 in the siderail may be employed, such as those discussed herein for holding dispenser 560 in table 10 or those discussed herein for holding container 28 in table 10.

Figure 17:
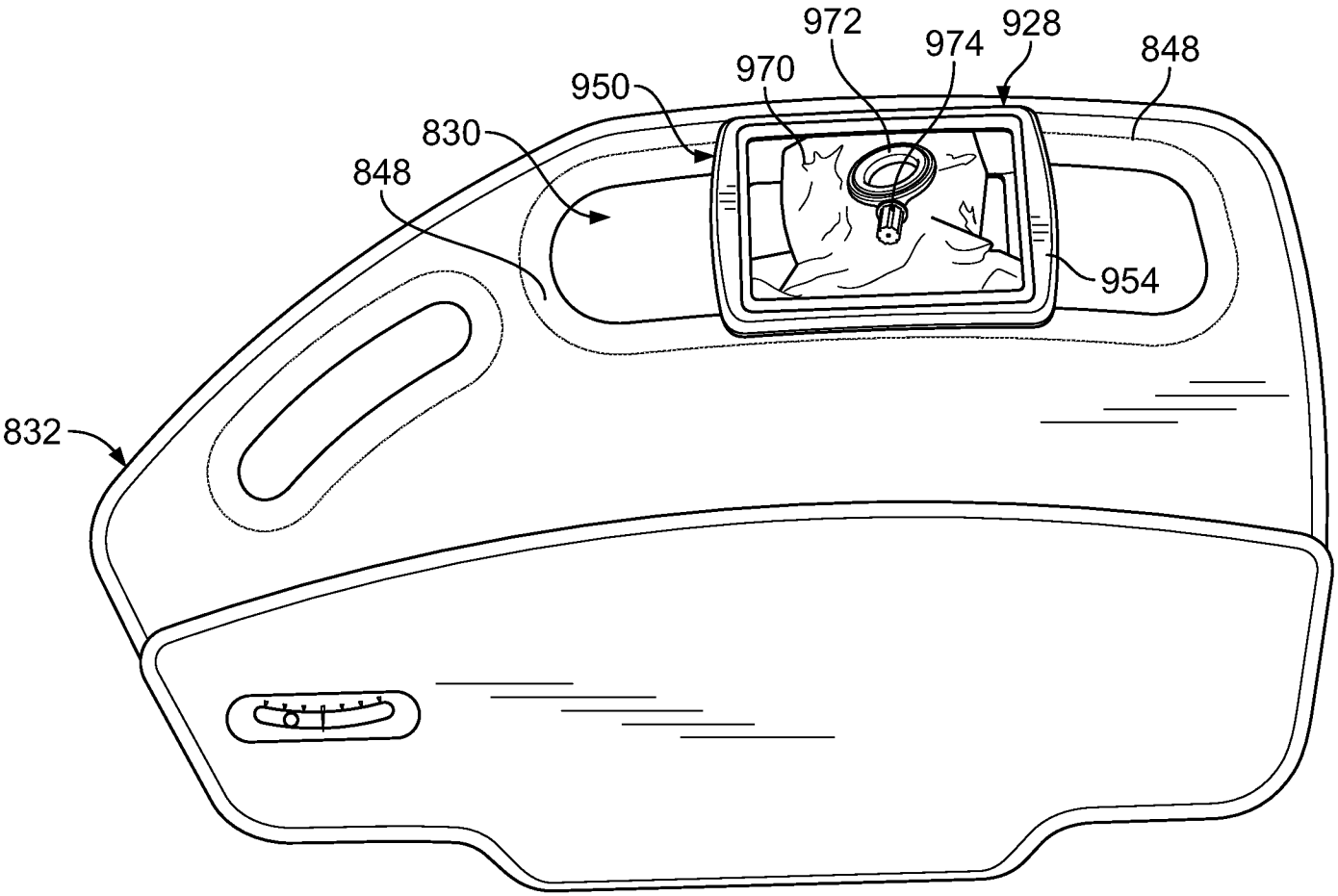
FIG. 17 is a front view of a siderail of a hospital bed, similar to the siderail of FIG. 16, and another container of the present disclosure positioned within an open space of the siderail, and showing an inner bag filled with a sanitizer substance and positioned within the container.

For example, another container 928 of the present disclosure is shown in FIGS. 17-20. Illustratively, the container 928 is similar to the container 828 and is configured to be positioned within the aperture or space 830 of the siderail 832 of a hospital bed. As shown best in FIG. 20, the container 928 includes a main body 950 including four side walls 952 and an outer rim 954 coupled to a front surface of the side walls 952. Illustratively, the four side walls include a top wall, a bottom wall, and spaced-apart right and left walls. A rear wall 956 of the container 928 includes two apertures 958 formed therein. Of course, it is within the scope of this disclosure for the rear wall 956 to be formed as a generally continuous surface void of any apertures, such as apertures 958, for example. Illustratively, the sidewalls 952 and rear wall 956 of the container 928 cooperate to define a sanitizer-receiving space 959 therein. The container 928 also includes a protrusion 960 coupled to the rear wall 956 and extending outwardly therefrom into the sanitizer-receiving space 959. Illustratively, the protrusion 960 may aide in retaining any sanitizer substances or materials within the space 959. The container 958 also includes a front wall (not shown) the same as or similar to the front wall 836 of the container 828 shown in FIG. 16. Similar to the front wall 836, the front wall of the container 928 may also include a removable lid and/or a push-down dispenser formed therein Looking now to FIG. 17, the container 928 is configured to be positioned within the opening 830 of the siderail 832. The container 928 may be positioned within the opening 830 and coupled to the siderail 832 in the same as or a similar manner as that described above with reference to the container 828. In other words, a top wall 952 of the container 928 is engaged with the upper rail portion 848 while a bottom wall 952 of the container 928 is engaged with a lower rail portion 848 of the siderail 832. As shown in FIG. 17, the container 928 includes a bag 970 having liquid or foam sanitizer (not shown) contained therein. Illustratively, the bag 970 includes a valve 972 whereby the sanitizer substance is delivered therefrom. This valve 972 is configured to interact with a dispenser on the front wall of the container 920 in order to allow the bag 970 to dispense the sanitizer substance contained therein. Illustratively, the dispenser may be a spring-loaded lever, a pump, or a push-button, for example. A removable cap 972 of the bag 970 is coupled to the valve 972. Illustratively, the bag 970 is provided as a disposable bag. However a refillable bag may be used as well. While the container 928 is shown to include a bag 970 contained therein, it is also within the scope of this disclosure for the container 928 to house a bag or box of sanitary-type wipes (not shown) therein. Such wipes may be accessible to a user through an opening in the front wall of the container 928, for example.

Figure 18:
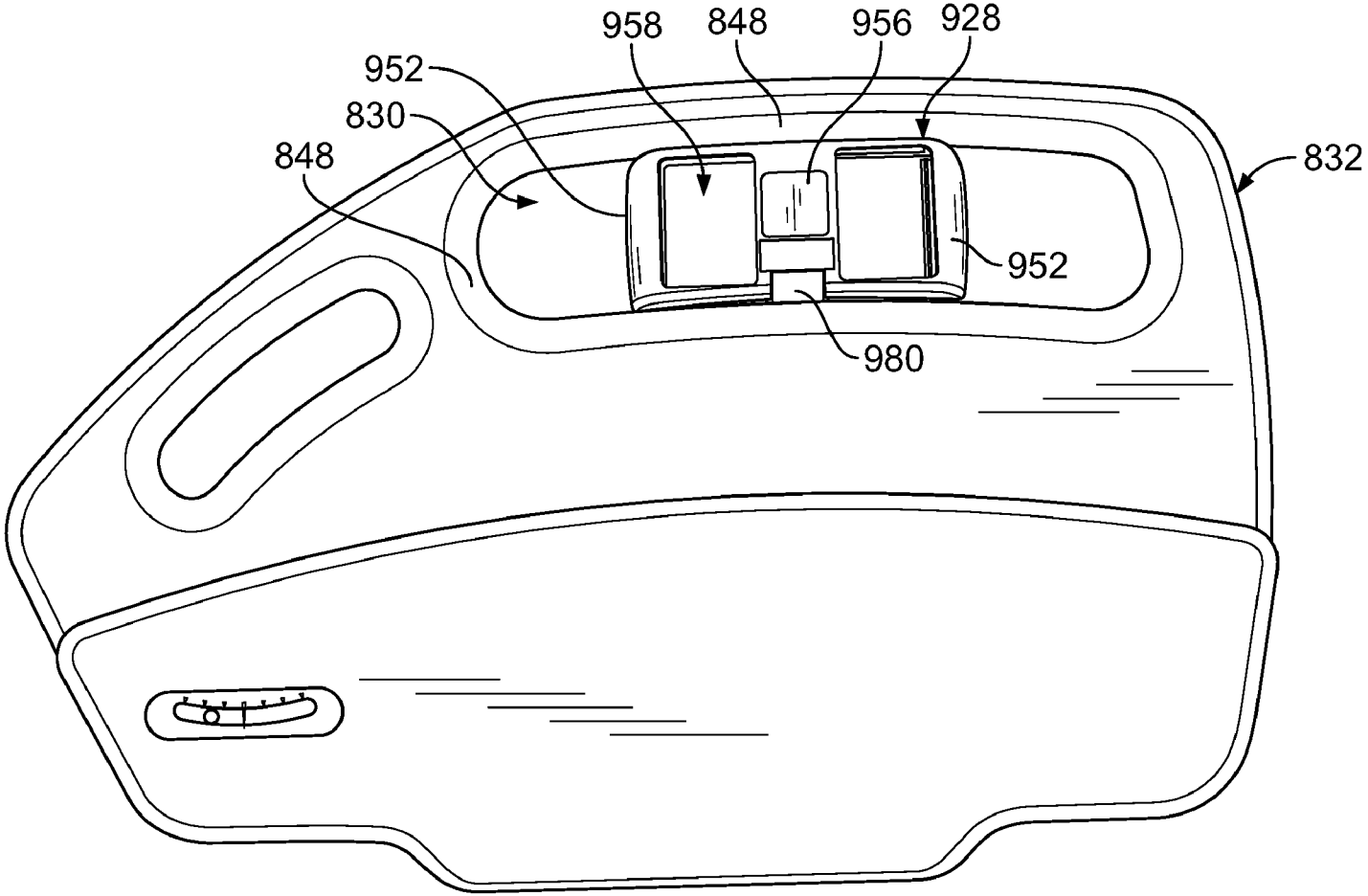
FIG. 18 is a rear view of the siderail and container of FIG. 17 showing a spring-loaded tab of the container engaged with the siderail to maintain the container within the space of the siderail.
Figure 19:
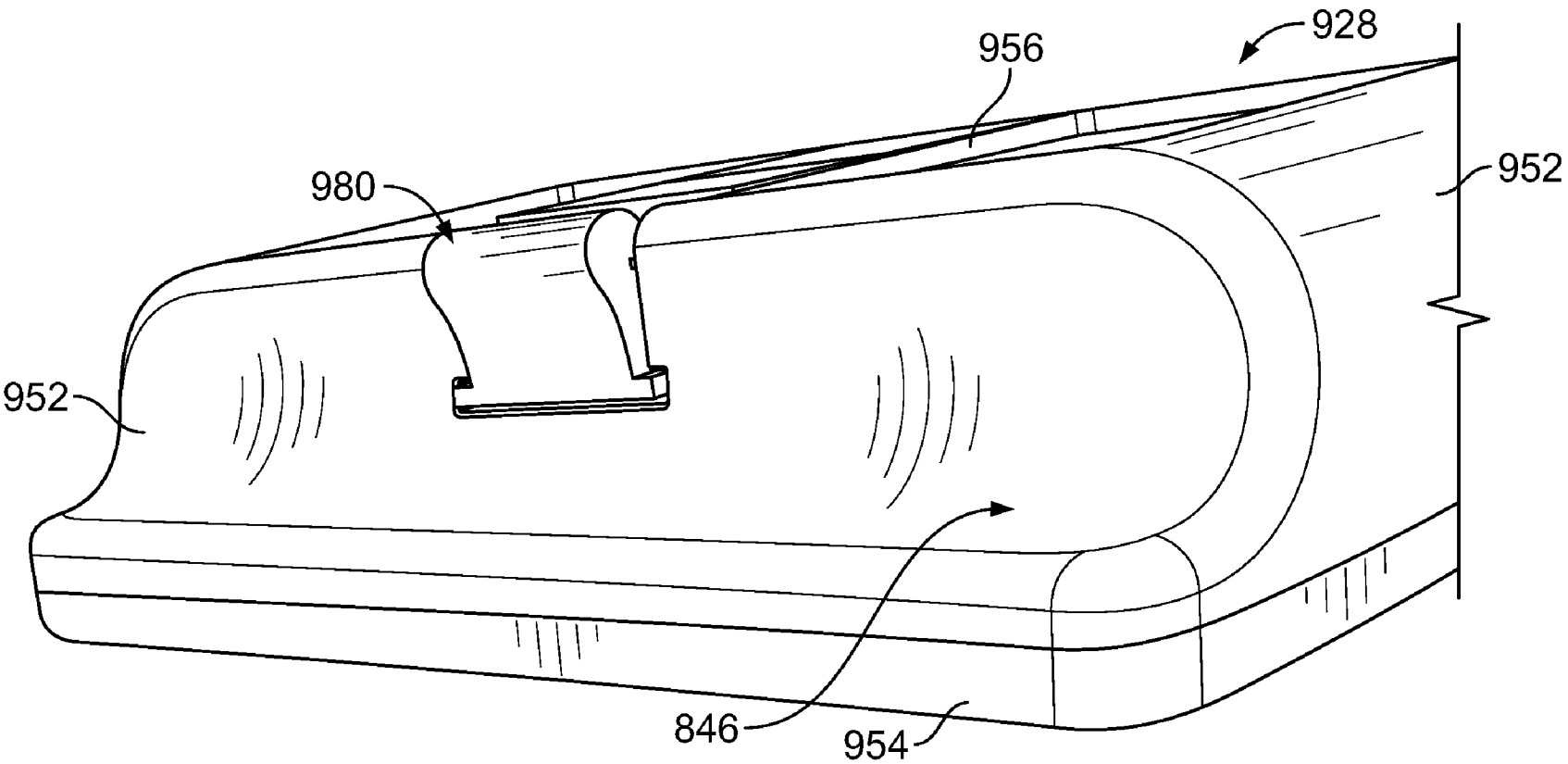
FIG. 19 is a bottom, rear perspective view of a portion of the container of FIGS. 17 and 18 showing the spring-loaded tab of the container.
Figure 20:
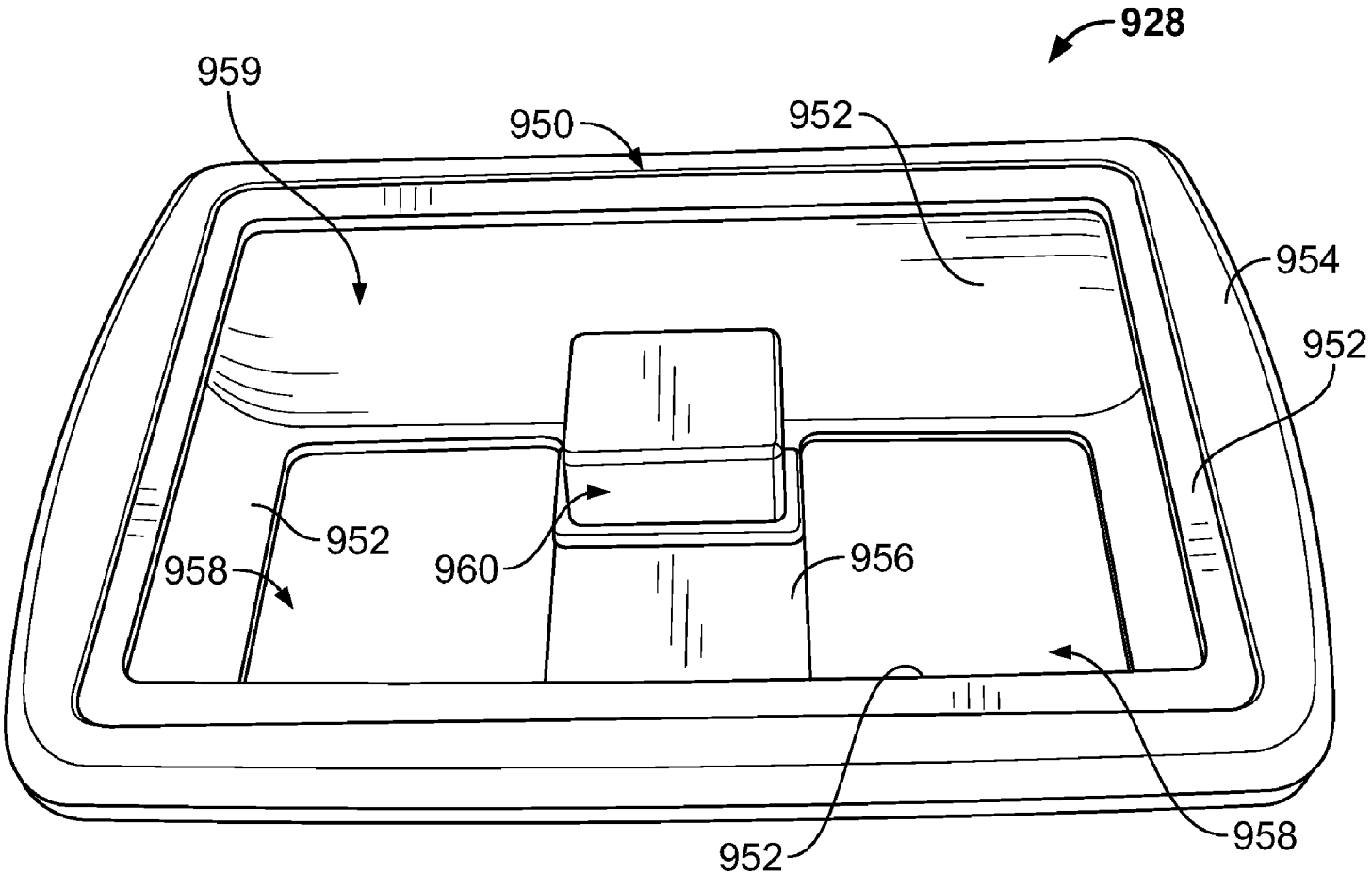
FIG. 20 is a front perspective view of a main body portion of the container of FIGS. 17-19.

Looking now to FIGS. 18 and 19, the container 928 further includes a spring-loaded tab 980 pivotably coupled to the main body 950 of the container 928 and movable relative to the main body 950 between an extended position (shown in FIG. 19) and a depressed or compressed position (shown in FIG. 18). Illustratively, the tab 980 is pivotably coupled to the bottom side wall 952 of the container 928 and is positioned adjacent the rear wall 956. In use, the spring-loaded tab 980 operates to maintain the container 928 within the opening 830 of the siderail 832 by providing an interference fit between the container 928 and the rail portions 848 of the siderail 832. In particular, the spring-loaded tab 980 may be moved to the compressed position to allow the container 928 to be positioned by a user within the opening 830 of the siderail. Once released, the spring-loaded tab 980 is biased toward the extended position to provide an outward force on the lower rail portion 848 of the siderail 832 to allow the container 928 to be held within the space 830.

Figure 21:
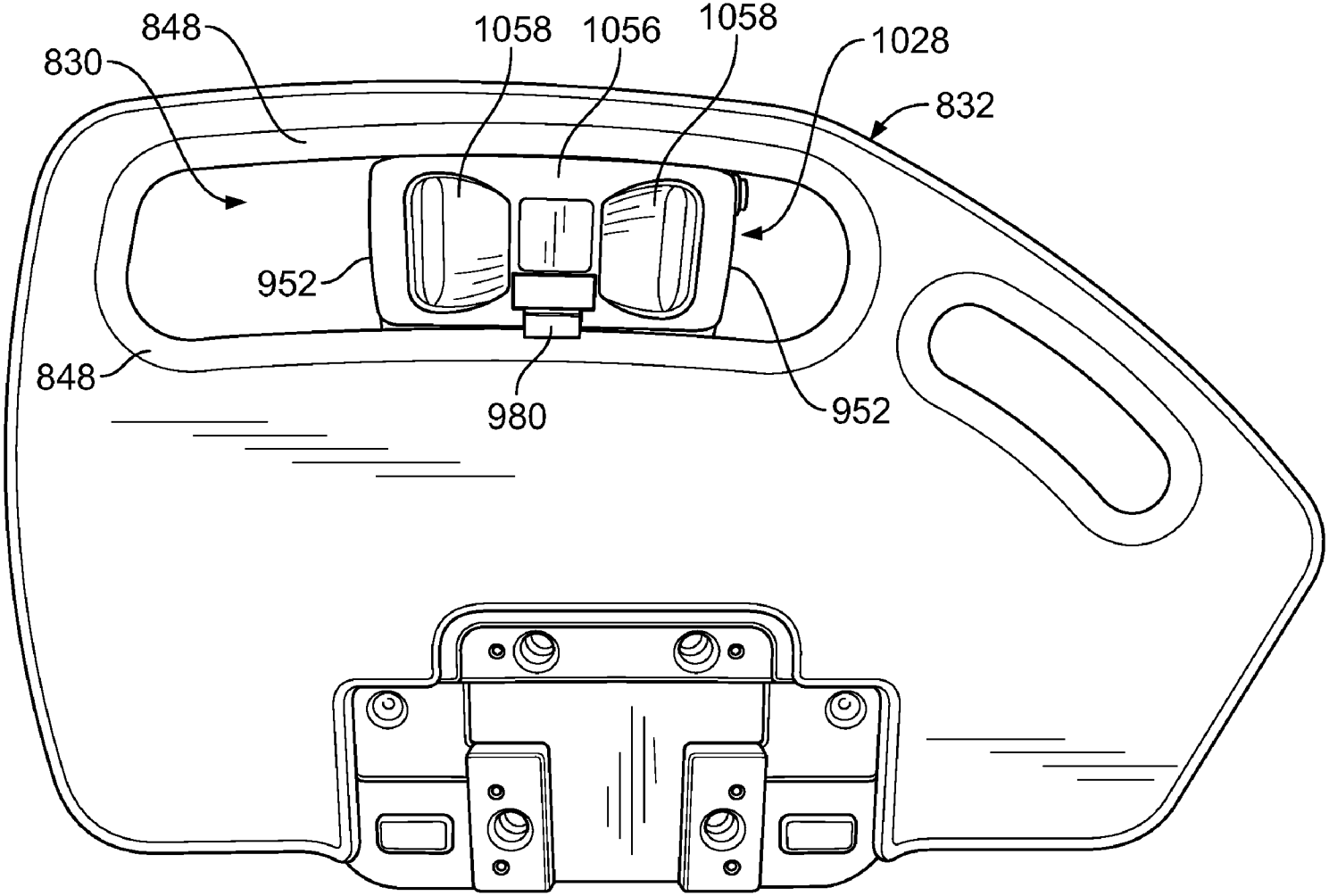
FIG. 21 is a rear view similar to FIG. 18 showing the siderail and another container of the present disclosure positioned within the open space of the siderail.

Looking now to FIG. 21, another container 1028, similar to the containers 28, 528, 828, and 928 discussed above is provided. Illustratively, the container 1028 is received and maintained within the space or opening 830 of the siderail 832 and may contain a liquid or foam sanitizer and/or sanitizer wipes therein. The container 1028 is similar to the container 928 in that it includes the spring-loaded tab 980 in order to maintain the container 1028 within the space 830. The container 1028 further includes a rear wall 1056 which includes recesses 1058 rather than the apertures 958 of the container 928 formed therein. Of course, it is within the scope of this disclosure to include other containers of other shapes and sizes which may be configured to be received and maintained within the space 830 of the siderail 832.

Illustratively, while the containers 828, 928, and 1028 shown in FIGS. 17-21 are provided for use with the illustrative siderail 828, as well as other siderails (not shown), it is within the scope of this disclosure to provide a retrofit sanitizer container which is particularly formed to fit within a particularly-sized opening of a particular siderail. In other words, it is within the scope of this disclosure to include sanitizer containers which are retrofit to be sized and shaped to accommodate the size and shape of any opening of an existing siderail. For example, a sanitizer container may be made having a top and bottom surface which generally follows the shape of the upper and lower rail of a siderail. Such retrofit sanitizer containers may also be sized and shaped to provide an interference-fit within the opening of the particular siderail for which they were made.

Figure 3:
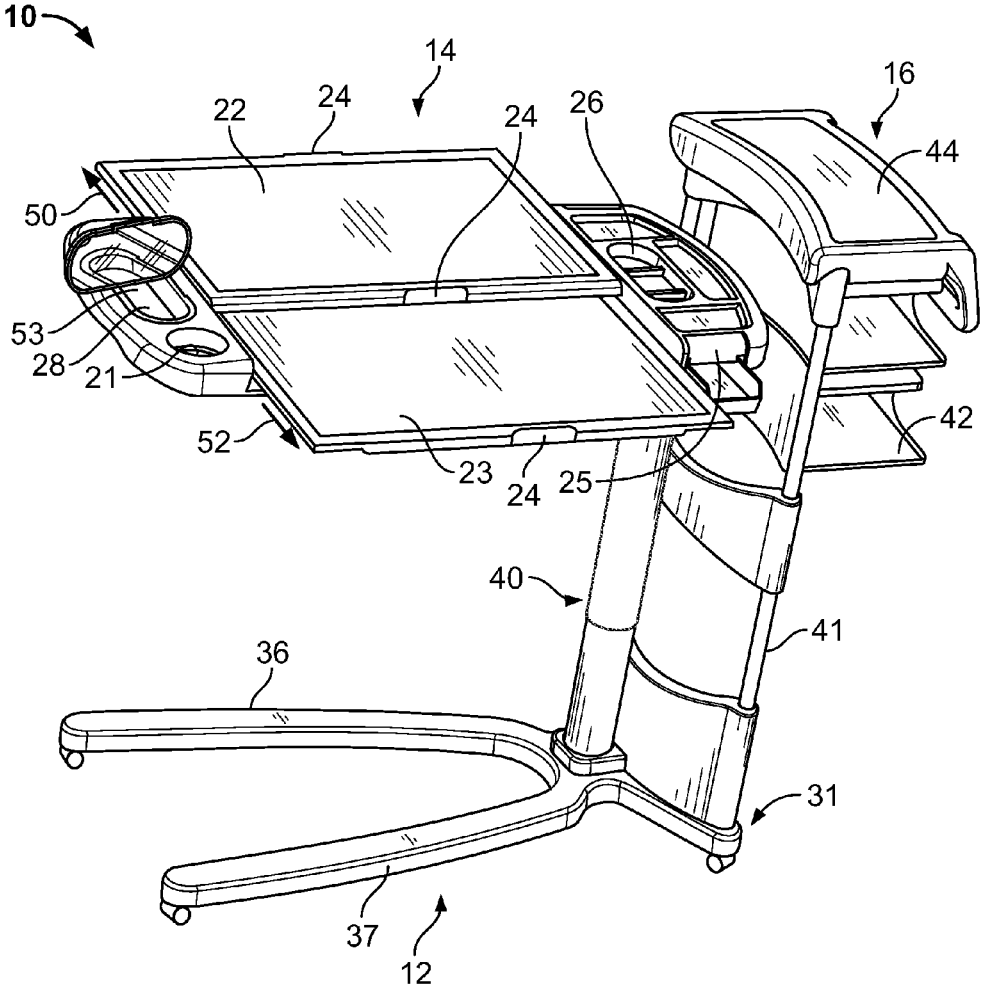
FIG. 3 is a perspective view of the overbed table of the example of FIG. 1, with the support surface shown in the lowered position and the table tops of the support surface assembly shown in the fully deployed position.
Figure 6:
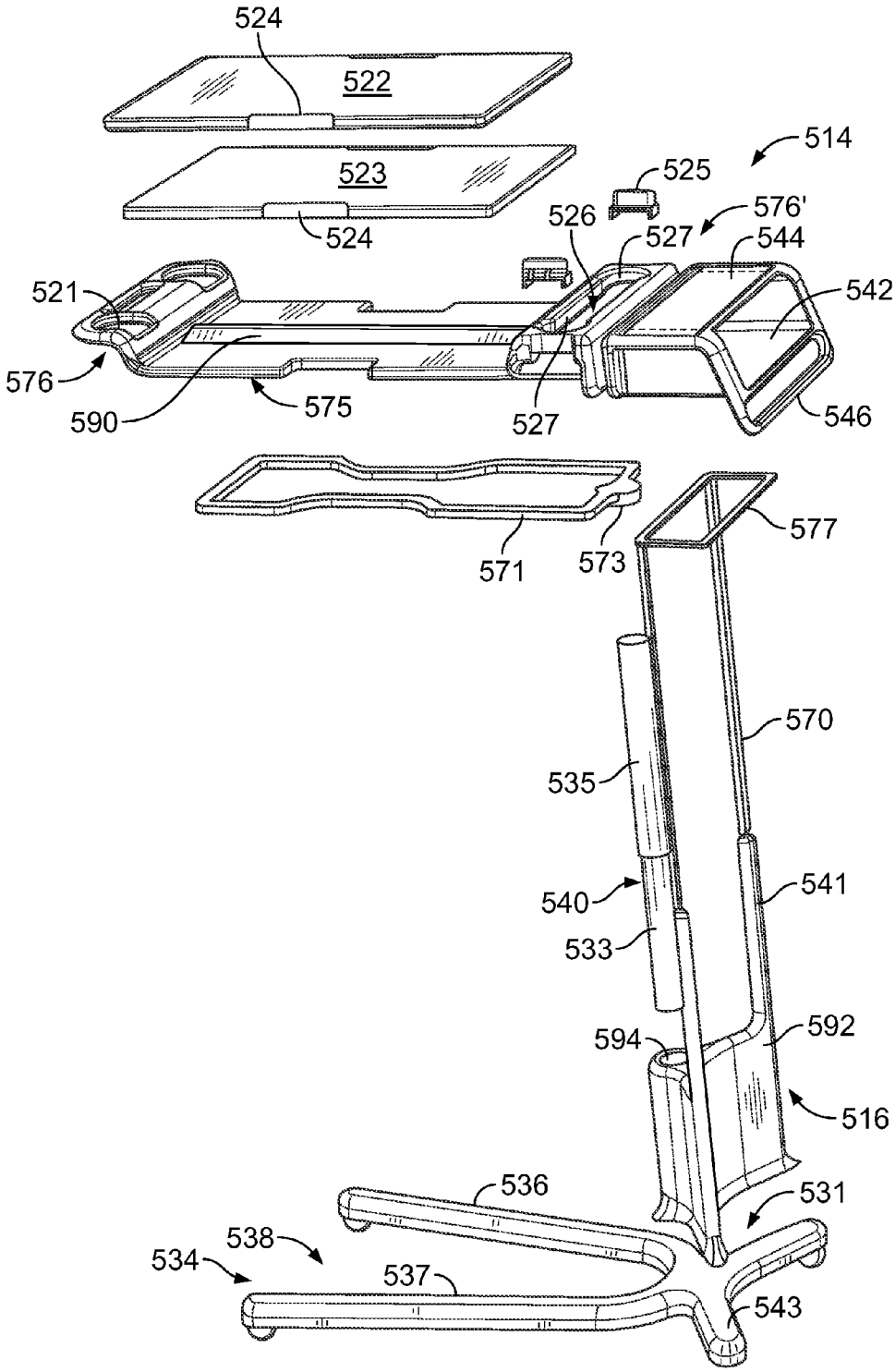
FIG. 6 is an exploded top perspective view of the embodiment of FIG. 5 showing additional detail of this embodiment, including illustrative frame components.

Looking now to FIGS. 3 and 6, two table tops may be provided in some embodiments, to increase the usable space of the table 10. FIG. 3 in particular shows the table tops 22, 23 of the support surface assembly 14 according to one illustrative embodiment of this disclosure in the fully deployed position. Here, the table tops 22, 23 may slide over one another to allow for increasing the table space. Another human interface device can be provided which releases and locks the sliding table tops 22, 23 in position. In this embodiment, levers 24 are provided for this purpose. When raised to the release position, the lever 24 allows the two table tops 22, 23 to slide relative to one another. The table tops 22, 23 may be able to slide horizontally in a first direction 50 and/or a second direction 52 independent of one another. The table tops 22, 23 are configured to slide in the first direction 50 and/or the second direction 52 such that they form a generally horizontal plane with respect to one another, increasing support space. The table tops 22, 23 may be extendable in either direction 50, 52 to the extent that a portion of the extended table top 22, 23 overlaps the other table top 22, 23, which may not be extended or may be only partially extended in either direction. The range of motion of at least one of the table tops 22, 23 may be limited by a locking mechanism (not shown) that restricts the movement of one of the table tops 22, 23 in one direction 50/52 when the other is already extended in that direction 50/52. An example of such a mechanism is described below with respect to FIG. 13. Detents or other locking arrangements could be used to lock the table tops in one or more extended positions. (e.g., a 5 lb breakaway force could break the tops from the locked position).

Figure 4:
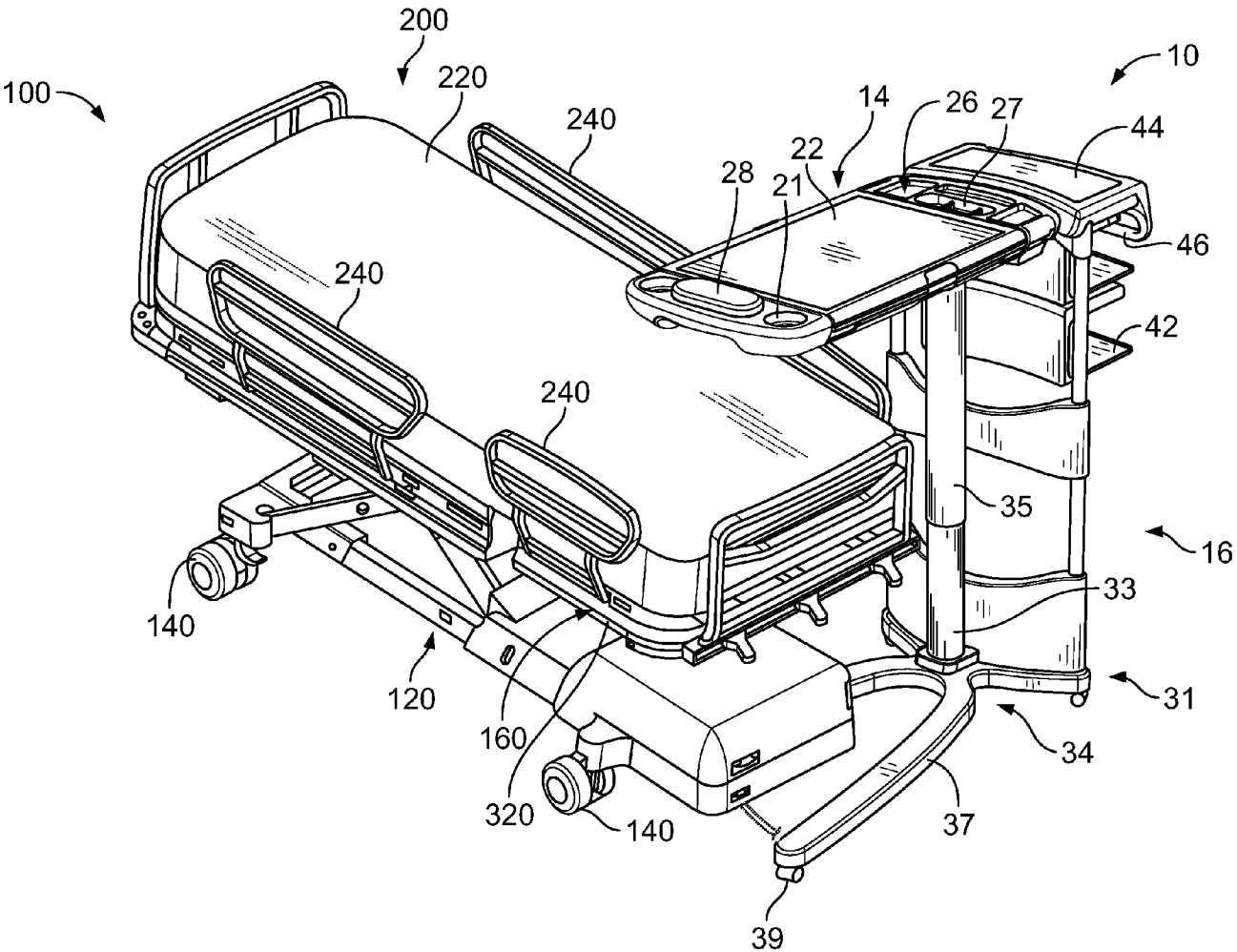
FIG. 4 is a perspective view of the overbed table example of FIG. 1, engaged with an exemplary bed by sliding the table adjacent the bed, such that a portion of the base is beneath the bed and positioned about a bed caster and the support surface assembly is located above the bed for patient use.

FIG. 4 is a top right perspective view of the overbed table example of FIG. 1, engaged with an example hospital bed 100 by sliding the table 10 adjacent the bed 100 such that the floor base section 34 is beneath the bed 100. The feet 36, 37 are positioned about a bed caster 140 and the support surface assembly 14 is positioned to be located above the bed 100 for patient use. The handle 46 may be used to push the table 10 into the desired position, while the wheels of the casters 39 roll on the floor surface 11. The generally U-shaped (or tuning fork shaped) splayed feet 36, 37 allow for positioning against a variety of bed types, stretcher types, caster types, or other equipment (e.g., chair, sink, medical device, etc). Illustratively, the base section 34 operates as an independent assembly separate from the vertical support column 40. However, the base section 34 may be designed unitarily with the vertical support column 40 as well. In this example, the feet 36, 37 straddle one caster 140 of the bed 100. The table top 22, cupholder 21, storage container 28, and recess 26 can be easily accessed and operated by the patient. The bins 42 and table top 44 can be used by the patient and/or caregiver. The bed 100 may include one or more siderails 240 that act as a barrier to the patient lying on the surface 220 of the mattress 200, locate the edge of the bed 100 or surface 220, and/or assist with patient ingress/egress. The illustrative container 828 shown in FIG. 16 may be used with the siderails 240 as well. The siderails 240 may have controls for operating the bed 100. For example, the head section 160 of the bed deck 320 can be articulated by the controls into a sitting up position. A motor may be coupled to the lower frame 120 which is operated by the control to articulate the deck 320 and move the deck 320 upward and downward. As noted above, the siderails 240 operate to generally locate the side of the bed 100. The siderails 240 may be moved upwardly and downwardly between raised, use positions to act as a barrier to the patient lying on the surface 220 of the mattress 200 and lowered, stowed positions wherein the siderails 240 are generally adjacent and below the surface 220 of the bed 200 in an out-of-the-way position to allow the patient unobstructed ingress/egress from the bed.

As shown in FIGS. 1-4, the human interface portions (e.g., the portions intended for operation, movement, or contact by the hands of the users, such as levers 24, 25 and handle 46) can be identified, for ease of viewing. For example, the levers 24, 25 may be a different color than the remainder of the table 10. A bright or easily distinguishable color may be used to assist in viewing these portions by someone visually impaired. Additionally, these levers 24, 25 and handle 46 may be made, in whole or in part, from an antimicrobial material. For example, the levers 24, 25 and handle 46 may be made from a plastic material that has silver nanoparticles incorporated therein and dispersed throughout. The nanoparticles may be less than 100 nanometers in all dimensions and may be made of elemental silver, silver ions, or silver-containing substances or compounds. An alternative to integrating the antimicrobial material into the levers 24, 25 and handle 46 may be to coat, paint, plate, or print the levers 24, 25 and handle 46 with a material that is made partially or entirely of antimicrobial agent. For example, silver nanoparticles of the size and type mentioned above may be incorporated in a paint, plating, coating, or ink, and the material applied to the exterior of the levers 24, 25 and handle 46, such as by coating, spraying, printing, etc. The antimicrobial agent may comprise other materials as alternatives or in addition. For example, a metal may be used which is selected from the group consisting of silver, gold, zinc, platinum and copper. The metal may be incorporated in elemental or ionic or compound form, and/or in colloidal form, on or in the levers 24, 25 and handle 46. Other components of the table 10 may be made from metal, plastic, fiberglass, and/or other suitable materials.

FIGS. 5-10 illustrate an overbed table 510 according to a second example embodiment. Many of the components of the overbed table 510 are similar to that of the overbed table illustrated in FIGS. 1-4. Components of similar construction to that of FIGS. 1-4 have the same last two reference numerals but are preceded with a "5. " These components can be of similar construction and operation as the embodiment of FIGS. 1-4, so the discussion above with respect to those components is incorporated by reference and applicable here, and need not be repeated. Additional structures are provided in this embodiment, however, by way of further example.

As shown in FIG. 6, the telescoping tube sections or structures 533, 535 may engage a recessed portion 573 of a table frame 571. The table frame 571 may support a table frame/platform 575 which is integrally formed with the side portions 576, 576'. The table tops 522 and 523 then rest upon the platform 575. Illustratively, the platform 575 includes a diverter channel 590 integrally formed with the top surface of the platform 575, as shown in FIG. 6. The diverter channel 590 extends along a length of the platform 575 from a proximal end of the platform 575 adjacent the vertical column 540 to a distal end of the platform 575 spaced laterally apart from the vertical column 540. The diverter channel 590 operates to divert any liquids (such as spilled water or other drinks that seep between the two table top sections 522, 523) outwardly away from the center of the platform 575. In other words, the raised channel 590 diverts liquid flow to the long sides of the platform 575 such that the liquid does not accumulate and dry on the platform 575, but rather is diverted outwardly to run off the platform 575.

Looking again to FIG. 6, in this example, the posts 541 of the side assembly 514 connect to a side assembly frame 570 which has a bin frame/platform 577. The bin frame/platform 577 supports and holds the bins 542 and its integrated handle 546 and side assembly table top 544 therein. A bottom molding 592 is coupled to and integrally formed with the support post 541 and includes a passageway 594 configured to receive the vertical column 540 therein.

Figure 5:
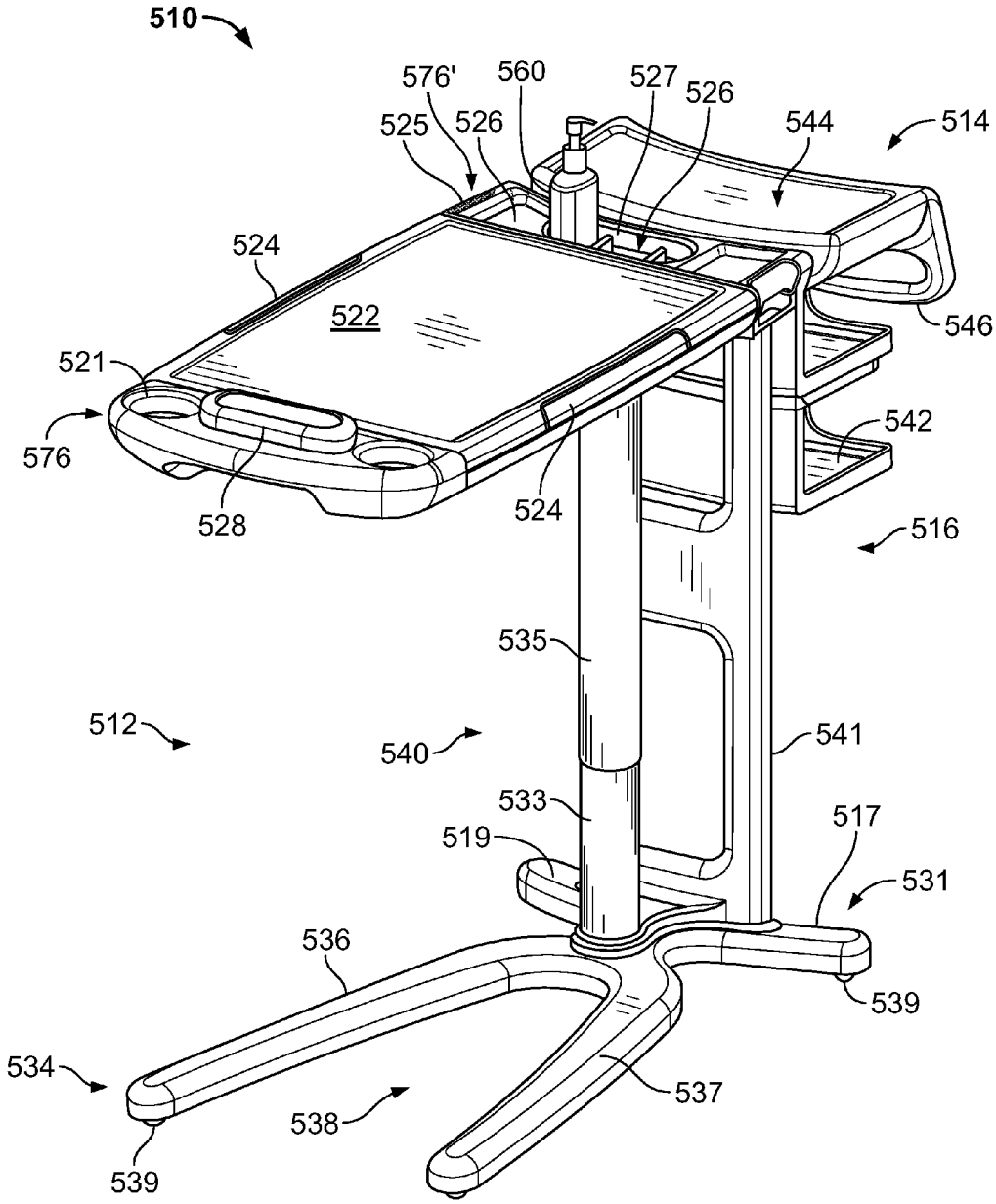
FIG. 5 is a perspective view of an overbed table according to a second illustrative embodiment, with the support surface assembly shown in the raised position and a hand cleaner container engaged in the container receptacle of the support surface.
Figure 7:
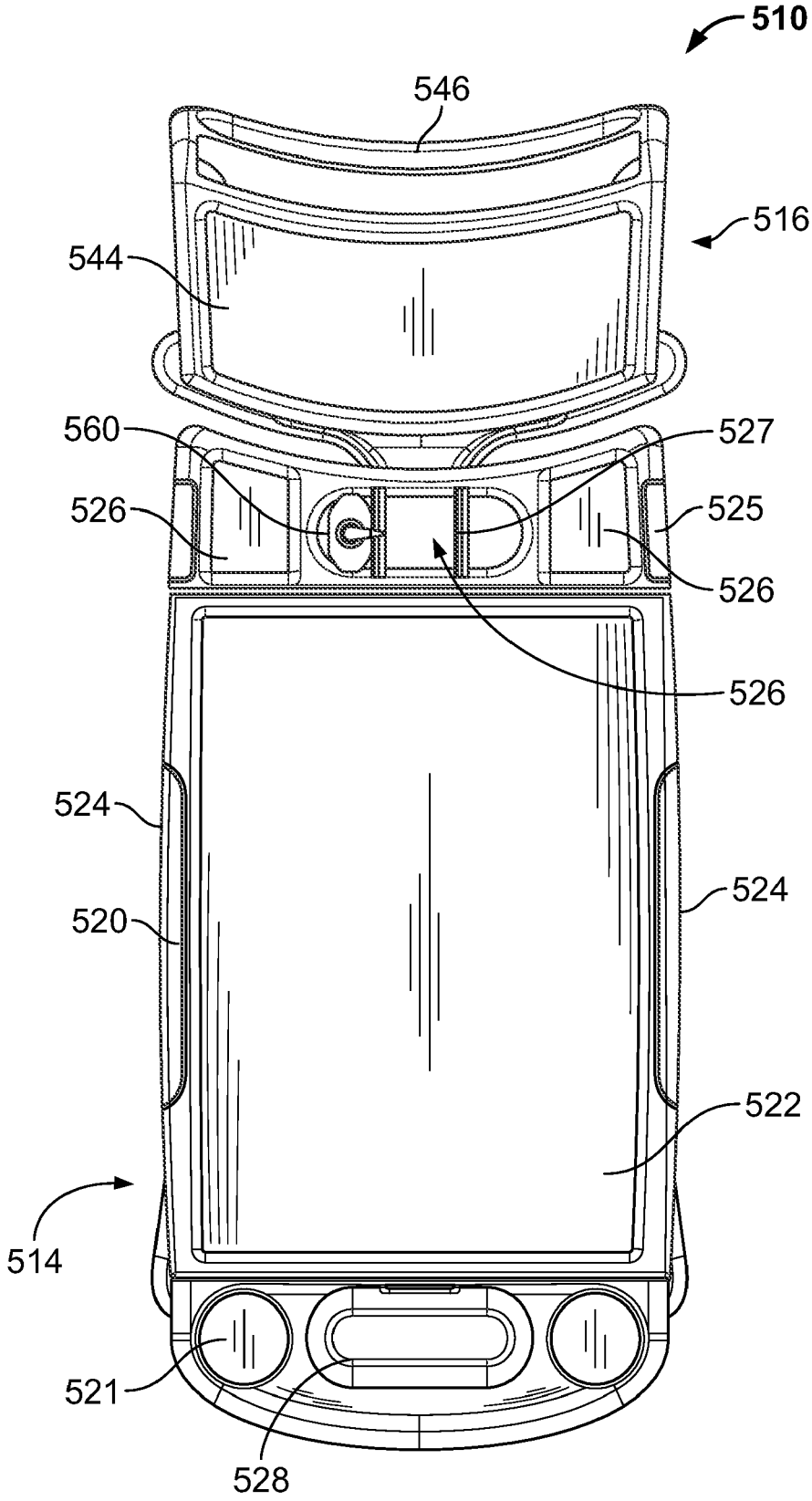
FIG. 7 is a top view of the embodiment of FIG. 5.
Figure 8:
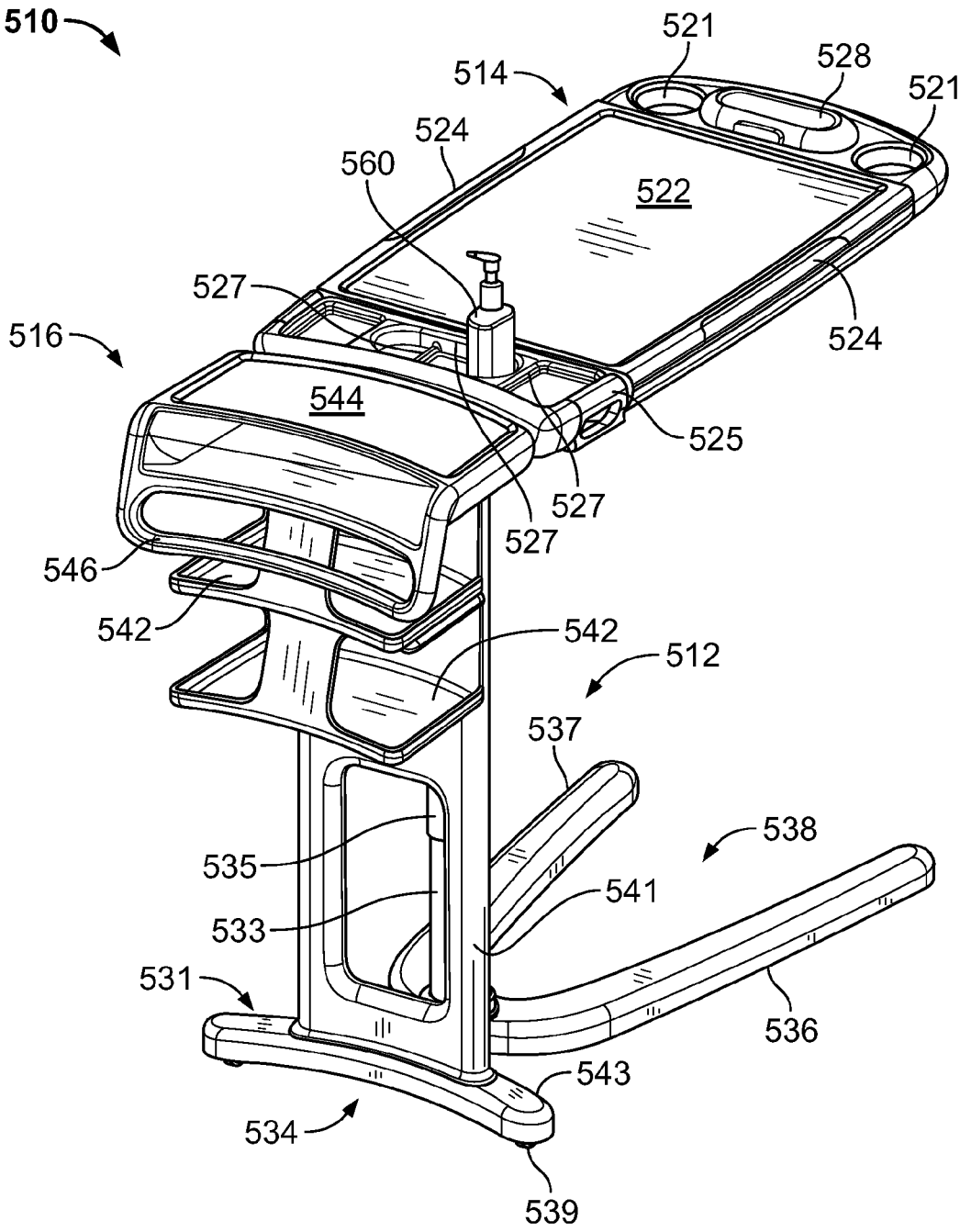
FIG. 8 is a rear perspective view of the illustrative embodiment of FIG. 5, showing the side assembly in more detail.
Figure 9:
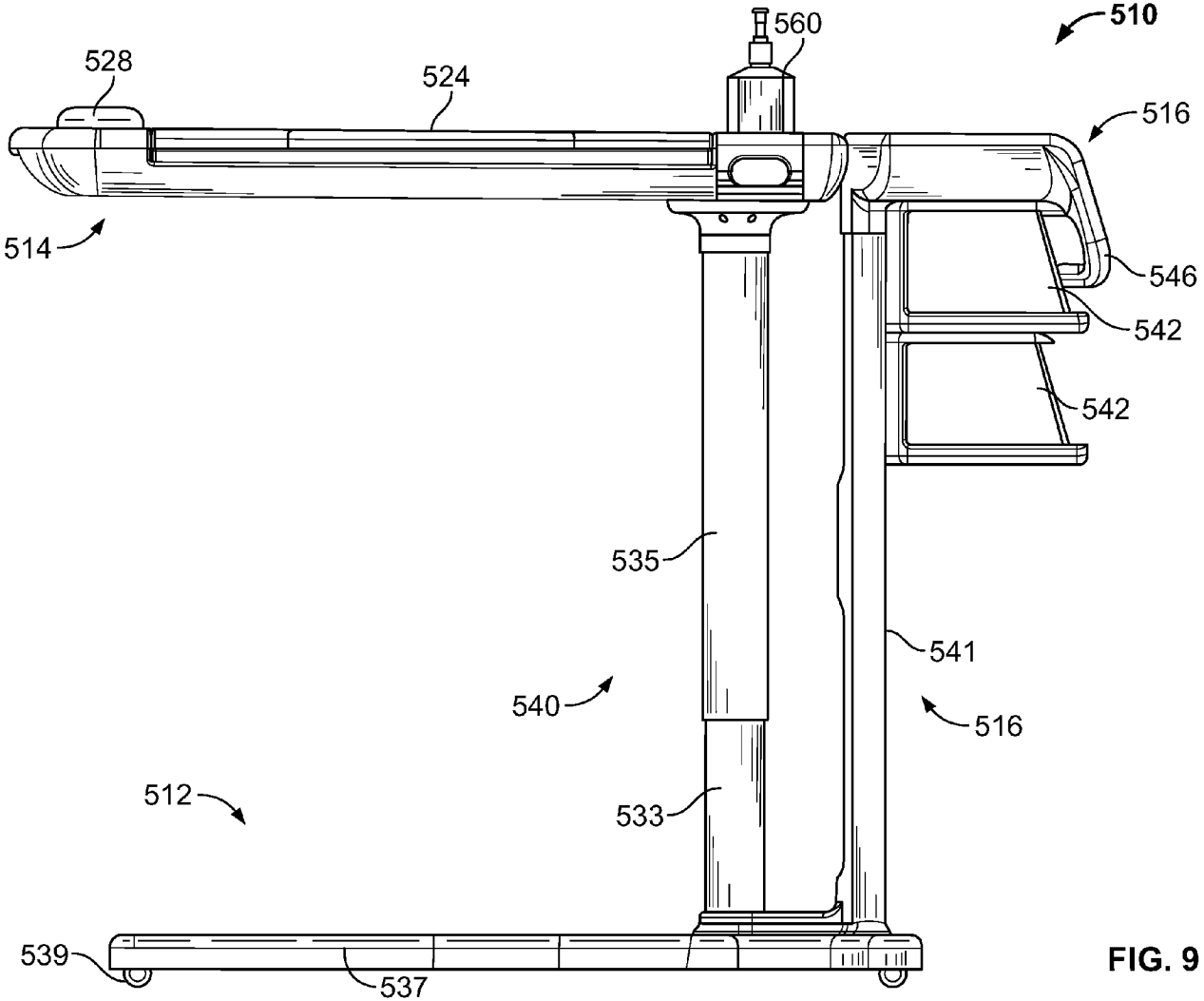
FIG. 9 is a side view of the embodiment of FIG. 5.

As best shown in FIGS. 5, 7, and 8, a container or dispenser 560 may fit within the recess 526 formed by one or more walls 527. In this example, the container 560 comprises a cleaning material dispenser. For example, the container 560 may dispense soap, lotion, gel, or hand sanitizer, such as hand sanitizing gel for example. Other dispensers and containers may fit within the recess 526, such as tissue or wipe dispensers, or storage dispensers, such as containers 28, 528, 828.

Figure 12A:
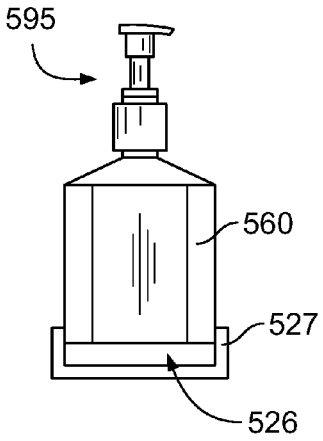
FIGS. 12*a*-12*c* illustrate various examples of ways to secure a container within a support surface recess housing, according to some embodiments.
Figure 12B:
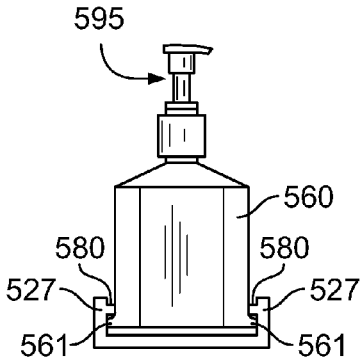
Figure 12C:
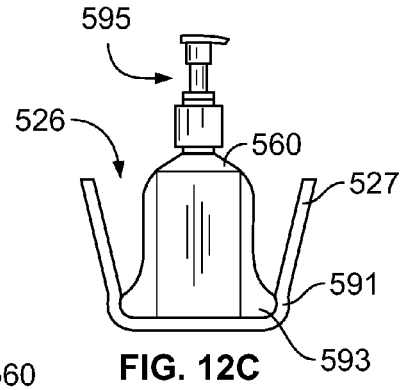

In some embodiments, the container 560 may lock within the recess 526. For example, the recess 526 may have walls 527 that define an interior housing 586. The exterior dimensions of the container 560 may closely match that of the interior housing 586 dimensions (or be slightly smaller) to provide a snug interference or friction fit to retain the container 560 therein. An example of such an arrangement is shown in FIG. 12*a*. The dispenser 560 may be flexible in nature so as to deflect inward slightly as it is placed in the recess 526. As another example, the dispenser 560 may have one or more outwardly extending protrusions 561 which fit below an inwardly extending protrusion 580 on one or more walls 527, such as is shown in FIG. 12*b*. Many other arrangements may be used for locking the dispenser in the recess 526. For example, the dispenser 560 may have a portion, such as lower portion, which is wider than that of a lower portion of the recess 526. Accordingly, an interference fit is made as the dispenser 560 is placed into the recess 526, resisting the movement of the dispenser. An example of this arrangement is shown in FIG. 12*c*. Here, the dispenser 560 includes a wider lower portion 593 and the recess 526 includes a narrower lower portion 591 which engage in an interface fit. Other mating or coupling structures may be utilized to retain the dispenser 560 on or in the table 510.

The dispenser 560 may include an upper nozzle mechanism 595 or otherwise an opening for dispensing the contents. The dispenser 560 may be made of a plastic material and may be removed from the recess 526 when empty or otherwise as desired. When empty, the dispenser 560 may be disposed of or recycled, and a new dispenser 560 with full contents put in its place in the recess 526.

As shown in FIG. 7, one or more of the human interface portions may include other indicia indicating that they are the portions to be grasped. In this example, the lever 524 includes raised lettering 570. The lettering 570 may be Braille lettering in one example.

Figure 10:
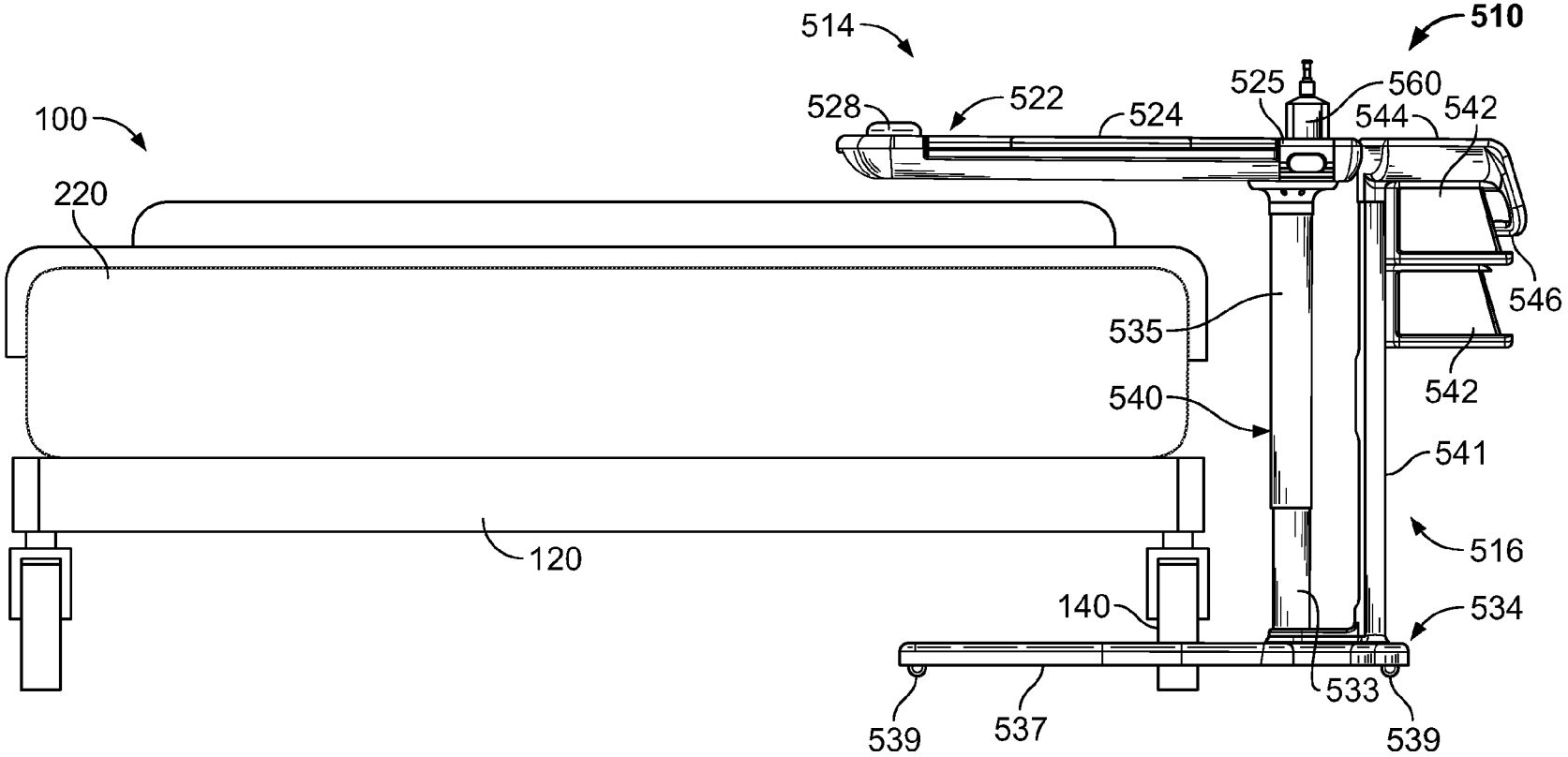
FIG. 10 is a side view of the embodiment of FIG. 5, in use and showing the generally U-shaped floor base engaging a caster wheel of a bed.

A side view of the embodiment of FIG. 5 is shown in FIG. 10. This figure shows the example table 510 in use with the generally U-shaped floor base 534 engaging a caster wheel 140 of a bed 100. The table top 522 extends over the top surface 220 of the bed 100, while the floor base section 534 extends under the bed's lower frame 120 and about a caster 140. The table top 522 and dispenser 560 and container 528 are positioned for easy access by a patient. The table top 522 may be extended by the patient by the use of the lever 524, and the vertical support or column 540 can be operated to raise and lower the table top by way of the lever 525. The side assembly 516 faces away from the bed and therefore is ideal for use by the caregiver. The side assembly table top 544 is positioned for use by the caregiver, as are the handle 546 for transport and the bins 542 for storage. The positioning of the recess 526 near the side assembly 516 in this example also allows for ease of access to the dispenser 560 by the caregiver. Accordingly, if the dispenser 560 contains hand sanitizer, the caregiver may easily access the dispenser for hand cleansing. The bed 100 may have features similar to the bed 100 described above or may have additional or fewer features as desired or needed.

Figure 13:
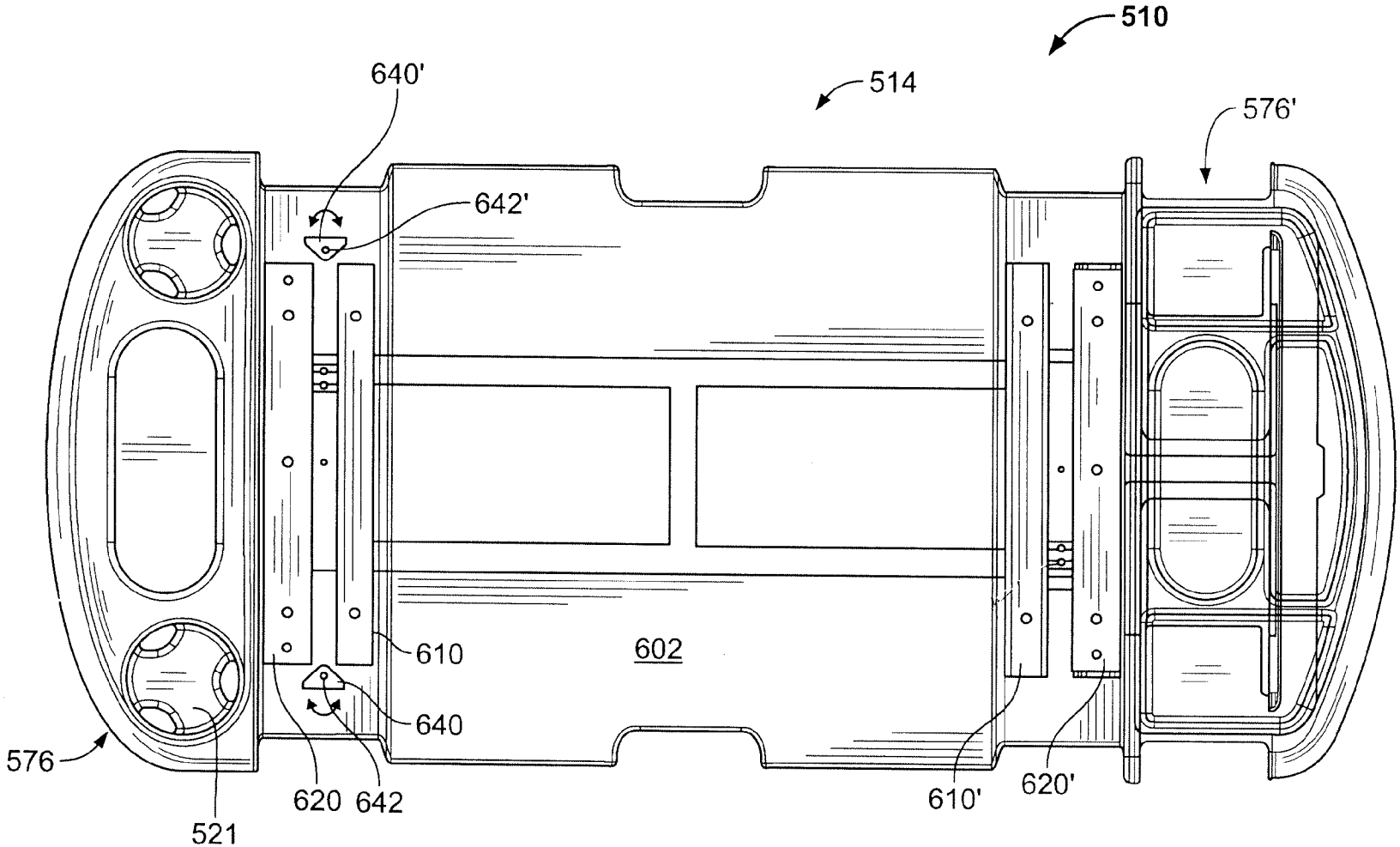
FIG. 13 is a bottom plan view of the support surface of the embodiment of FIG. 5.

FIG. 13 is a plan view of the bottom side 602 of the support surface assembly 514 of the embodiment of FIG. 5. This view provides an example of a locking mechanism that can be used to prevent the table tops 522/523 from moving in the same direction at the same time. In this example, one of the table tops includes side tracks 620/620' coupled thereto and the other includes side tracks 610/610'. The table tops slide by sliding along tracks 610/610' and 620/620' via corresponding tracks (and/or similar corresponding structures). Locking mechanisms 640/640' on opposite sides of the table prevent the table tops 522/523 from sliding in the same direction. Accordingly, the risk of tipping and/or user confusion as to operation can be reduced in this example. The locking mechanisms 640/640' in this example are pivots (such as triangular blocks for example) that rotate (or are "tripped") when one of the table tops 522/523 is extended outward from the home position shown in FIGS. 5/13 to the extended position (such as shown in the embodiment of FIG. 3). The contact of the track or top with the locking mechanism 640/640' as it is being extended rotates the mechanism about point 642/642' and causes it to block the other track/top from being moved in that same direction. The pivot 640/640' is held in position by its contact with the extended top/track and is prevented from rotating back to the home position. Thus, an attempt to also extend the other top in that direction would be prevented by the pivot blocking the way and being prevented from rotation back. If the other top was extended in that direction first, then the mechanism 640/640' would rotate in the opposite direction blocking the other track from being extended in that same direction. A biasing mechanism, such as a spring (not shown) for example, may be used for keeping the locking mechanism in the middle position when both tops are slid to the home position.

Figure 11A:
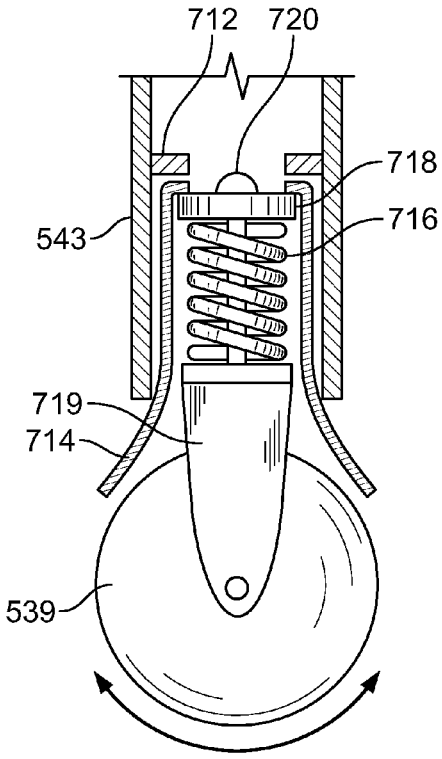
FIGS. 11*a*-11*b* are partial sectional views of locking caster assemblies that can be used with one or more of the embodiments above or with other embodiments, according to additional principles of the present disclosure.
Figure 11B:
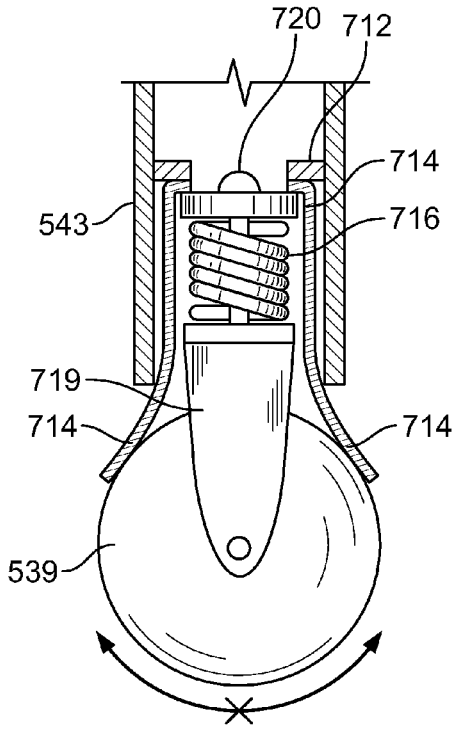

In some embodiments, the wheels 39, 539 of the overbed table 10, 510 may be weight activated, self-locking casters. FIGS. 11*a*-11*b* show an example of such a caster system including such a locking mechanism. Here the wheel 539 is held within a shroud 543 of the base member 534. A bracket 719 connects to the wheel 539, and upon the bracket 719 rests a spring 716 covered by a top support 718. The bracket 719 is rotatably fixed to the wheel 539 and is held to the spring 716 and support 718 via a pin 720 extending through the support 718 and spring 716 to the bracket 719. A collar or locking mechanism 714 is located over the spring 716 and the top support 718 and extends downwardly adjacent the wheel 39, 539. The shroud 543, which can be the base of the table, post, leg, or other support, includes an inwardly protruding ridge 712. The spring 716 provides a biasing force to maintain separation between the wheel 539 and the collar 714 when normal weight is placed on the table 10, 510. However, when excessive weight, or the weight of a predetermined amount, is placed on the table (e.g., in excess of 40 pounds, or in excess of the typical weight of a toddler or adult) the post 541 protrusion 712 pushes downwardly on the support surface 718 to compress the spring 716 and thereby cause the collar 714 to contact the wheel 539. Thus rotation of the wheel 539 is resisted by the friction between the collar 714 and the wheel 539. Illustratively, the collar 714 may be provided to contact multiple surfaces and/or sides of the wheel 539 to provide increased frictional resistance against rotation of the wheel 539. In other words, the collar 741 may completely surround the wheel 539 and/or may be positioned adjacent multiple sides or portions of the wheel 539 in order to engage or contact the multiple surfaces or portions of wheel 539 when activated. Accordingly, automatic safety locking of the table may be achieved in this embodiment. The type of spring utilized can determine what weight range will activate the braking effect.

Figure 14:
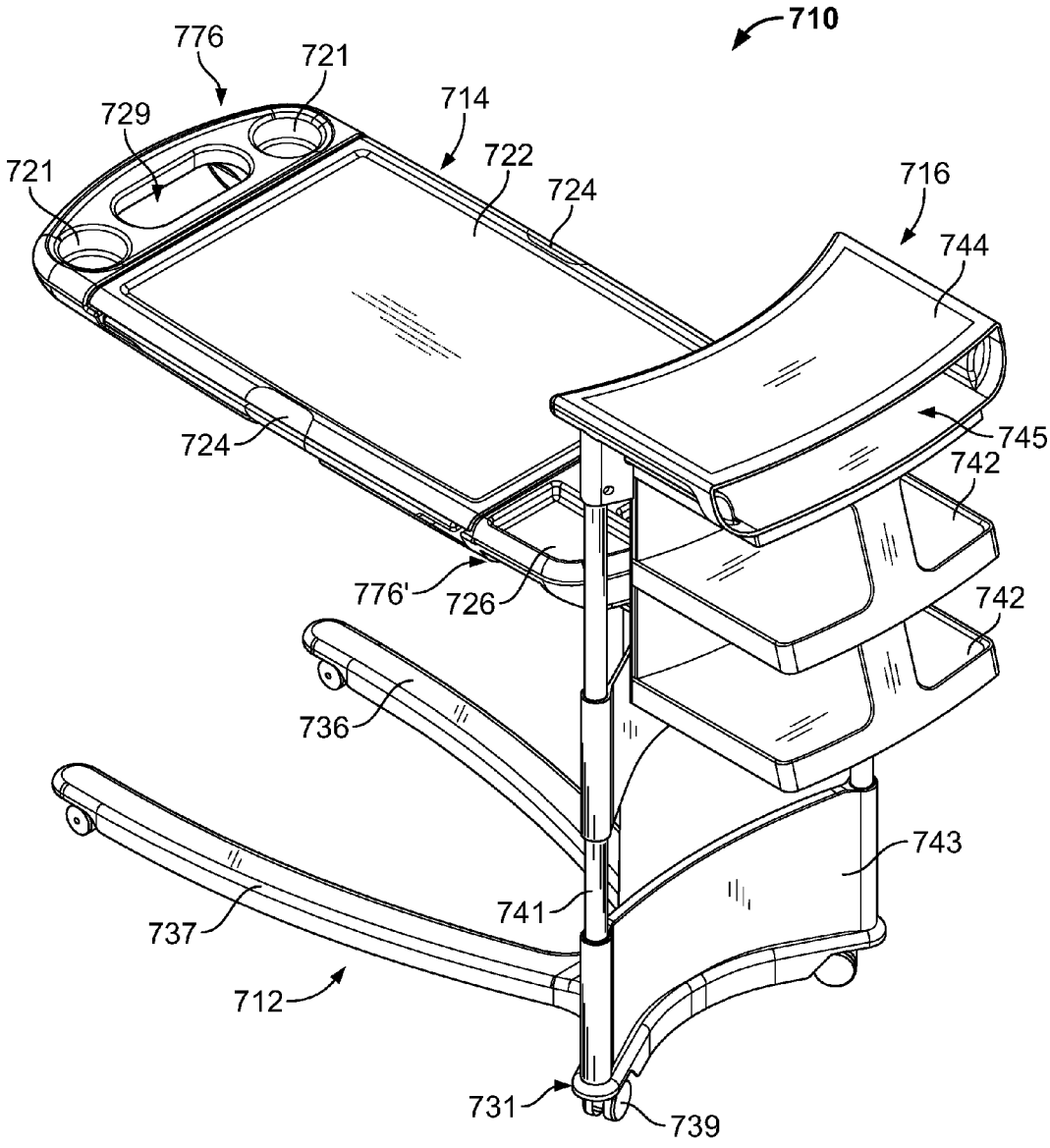
FIG. 14 is a rear perspective view of another overbed table according to a third illustrative embodiment of the present disclosure.

Looking now to FIG. 14, another overbed table 710 according to a third illustrative embodiment is provided. Many of the components of the overbed table 710 are similar to that of the overbed table 10 illustrated in FIGS. 1-4 and the overbed table 510 illustrated in FIGS. 5-10. Components of similar construction to that of FIGS. 1-10, therefore, have the same last two reference numerals but are preceded with a "7." These components can be of similar construction and operation as the embodiments of FIGS. 1-4 and of FIGS. 5-10, so the discussion above with respect to those components is incorporated by reference and applicable here, and need not be repeated. Additional structures are provided in this embodiment, however, by way of further example. As shown in FIG. 14, the side assembly 716 of the overbed table 710 is similar to the side assembly 16 shown in FIG. 1-4. However, the side assembly 716 does not include the handle 46 of the side assembly 16. The side assembly 716 further includes the pair of posts 741 coupled to and rising from the side portion 731 of the floor base section 734. As discussed above in reference to the overbed table 10 of FIGS. 1-4, the posts 741 couple to and support a side assembly table top 7644. Connected to the posts 741 and/or the side assembly table top 744 are the bins 742 as well as an upper enclosed bin 745. Other shelves, pockets and the containers may be connected to the side assembly 716, for storage of items. For example, the side moldings 743, which provide support and protection for the system, can include one or more pockets or compartments.

Many other embodiments that incorporate one or more of the various principles described herein are possible. In one embodiment, an item support apparatus is provided, comprising a support surface assembly configured for placement of items. A base assembly is coupled with the support surface assembly and configured for placement of the support surface assembly adjacent a patient support apparatus. A hand sanitizer container housing is coupled with the support surface assembly and configured to receive a removable hand sanitizer container unit. The housing may be integral or non-integral with the support surface assembly.

In another embodiment, a system for cleaning is provided comprising a base assembly configured for positioning of a support surface adjacent a patient support apparatus. The support surface assembly is coupled to the base assembly, and is configured for placement of an item. The support surface assembly is configured to be placed over a patient support apparatus (e.g., a bed or stretcher) when the base assembly is adjacent a patient support apparatus. The support surface assembly is coupled to a container receptacle. The system further includes a removable container sized to engage the container receptacle and containing a cleaning material.

In another embodiment, an item support apparatus is provided comprising a base assembly configured for positioning of a support surface adjacent a patient support apparatus. The support surface assembly is coupled to the base assembly, and is configured to support an item thereon. The support surface assembly is further configured to be positionable over a patient support apparatus when the base assembly is adjacent the patient support apparatus. A transport member is coupled to the base assembly and configured to assist in moving the base assembly across a floor. The apparatus further includes a locking mechanism configured to frictionally engage the transport member to resist movement of the transport member upon a weight of a predetermined amount being placed on the support surface.

In a further embodiment, an item support apparatus is provided, comprising a base assembly configured for positioning of a support surface adjacent a patient support apparatus. The base assembly includes a vertical support column. The support surface assembly is coupled to the base assembly and is configured to support an item thereon. The support surface assembly is configured to be placed over a patient support apparatus when the base assembly is adjacent the patient support apparatus. The apparatus further includes a side assembly positionable adjacent the vertical support column, and configured for storage or placement of an items. The side assembly is vertically stationary, while the vertical support column is vertically adjustable to adjust the height of the support surface assembly.

In yet another embodiment, an item support apparatus is provided comprising a base assembly configured for placement of a support surface adjacent a patient support apparatus. The support surface assembly is coupled to the base and is configured to support an item thereon. The support surface assembly is configured to be positionable over a patient support apparatus when the base assembly is adjacent the patient support apparatus. The support surface assembly comprises a pair of movable table top sections, wherein the first movable table top section is movable in a first direction and the second movable table top section is movable in a second direction. The support surface further comprises a locking mechanism configured to limit the range of movement of the second movable table top section in the second direction until the first movable table top section is first deployed in the first direction According to another embodiment, an item support apparatus is provided comprising a base assembly configured for placement of a support surface assembly adjacent a patient support apparatus, and a support surface assembly coupled to the base assembly. The support surface assembly is configured to be placed over the patient support apparatus when the base assembly is adjacent the patient support apparatus. The support surface assembly includes at least one human interface portion configured to be contacted by the user for operation of the apparatus. The at least one human interface portion comprises an antimicrobial agent, such as metal particles.

In yet another embodiment, an item support apparatus is provided comprising a base assembly configured for placement of a support surface assembly adjacent a patient support apparatus. The support surface assembly is coupled to the base and configured for placement of an item. The support surface assembly is configured to be placed over a patient support apparatus when the base assembly is adjacent a patient support apparatus. The support surface assembly includes at least one human interface portion configured to be contacted by the user for operation of the apparatus. The at least one human interface portion includes a visual indicator identifying it as the interface portion. The visual indicator may be a color differing from the remainder of the support surface, or raised lettering such as Braille lettering for example.

The foregoing description of various embodiments and principles of the disclosure have been presented for the purposes of illustration and description. It is not intended to be exhaustive or to limit the disclosure to the precise forms disclosed. Many alternatives, modifications and variations will be apparent to those skilled in the art. Moreover, although multiple inventive aspects and principles have been presented, these need not be utilized in combination, and various combinations of inventive aspects and principles are possible in light of the various embodiments provided above. Accordingly, the above description is intended to embrace all possible alternatives, modifications, aspects, combinations, principles, and variations that have been discussed or suggested herein, as well as all others that fall within the principles, spirit and broad scope of the inventions defined by the claims.

Although the invention has been described in detail with reference to certain preferred embodiments, variations and modifications exist within the spirit and scope of the invention as described and defined in the following claims.

The invention claimed is:

1. An overbed table comprising:

a base assembly;

a vertical support column coupled to the base assembly and configured to move upwardly and downwardly relative to the base assembly;

a support surface assembly coupled to the vertical support column and configured for placement of items thereon wherein the support surface assembly includes a table top having (i) a pair of movable table top sections;

(ii) a table top locking mechanism configured to prevent movement of one of the table top sections in a first direction if the other table top section has been moved in the first direction;

wherein each table top section of the pair of table top sections is configured to be movable in a second direction opposite the first direction when the other of the table top sections is moved in the first direction, a column locking mechanism coupled to the support surface assembly and configured to actuate the movement of the vertical column; and a side assembly coupled to the base assembly and positioned adjacent the support surface assembly, wherein the support surface assembly is configured to move upwardly and downwardly with the vertical support column relative to both the base and the side assembly.

2. The overbed table of claim 1, wherein, the side assembly includes a side support surface and a storage bin coupled to the side support surface.

3. The overbed table of claim 1, wherein the side assembly further includes a side surface and a support post coupled to and extending between the side surface and the base assembly, wherein the support post is parallel with and spaced-apart from the vertical support column.

4. The overbed table of claim 1, wherein the support surface assembly includes a first storage section coupled to the table top and positioned adjacent a proximal end of the table top, and a second storage section coupled to the table top and positioned adjacent a distal end of the table top.

5. The overbed table of claim 4, wherein the first storage section includes a plurality of open storage receptacles formed therein and the second storage section includes a cup holder and a container.

6. The overbed table of claim 4, wherein the table tops are movable relative to the first and second storage sections.

7. The overbed table of claim 1, wherein the base assembly is generally U-shaped to define a first elongated foot and a second elongated foot spaced-apart from the first elongated foot.

8. The overbed table of claim 7, wherein the distal end of each of the first and second elongated feet is spaced farther apart than the proximal end of each of the first and second elongated feet.

9. An overbed table comprising:

a base assembly;

a vertical support column coupled to the base assembly and configured to move upwardly and downwardly relative to the base assembly; and a support surface assembly coupled to the vertical support column and configured to move upwardly and downwardly with the vertical support column relative to the base assembly, wherein the support surface assembly includes a table top having a pair of movable table top sections, a locking mechanism configured to prevent movement of one of the table top sections in a first direction if the other table top section has been moved in the first direction,wherein each table top section of the pair of table top sections is configured to be movable in a second direction opposite the first direction when the other of the table top sections is moved in the first direction, a first storage section positioned adjacent a proximal end of the table top supported by the vertical support column, and a second storage section positioned adjacent a distal cantilevered end of the table top.

10. The overbed table of claim 9, wherein the second storage section includes a cup holder and the first storage section includes a recessed portion configured to receive a hand sanitizer container unit therein.

11. The overbed table of claim 10, wherein the first storage section further includes a locking portion configured to lock the container within the recessed portion.

12. The overbed table of claim 9, further comprising a side assembly positioned adjacent the vertical support column such that the first storage section is positioned between the side assembly and the table top.

13. The overbed table of claim 9, wherein the support surface assembly includes at least one human interface portion comprising an antimicrobial agent.

14. The overbed table of claim 13, wherein the human interface portion comprises at least one of a handle, lever, button, latch, and grip portion, and wherein the antimicrobial agent comprises at least one of a metal and metal compound.

15. The overbed table of claim 9, wherein the base assembly includes at least one wheel and at least one locking mechanism configured to lock the wheel upon a weight of a predetermined amount being placed on the support surface assembly.

16. The overbed table of claim 15, wherein the locking mechanism is configured to frictionally engage at least two sides of the wheel to resist movement of the wheel upon the weight of the predetermined amount being placed on the support surface assembly.

17. The overbed table of claim 9, wherein one of the first and second storage sections includes a mirror movable from a stowed position to a use position.

18. The overbed table of claim 9, wherein the locking mechanism includes a generally triangular member pivotably coupled to a platform of the support surface assembly.

19. The overbed table of claim 9, wherein the support surface assembly includes at least one human interface portion configured to be contacted by the user for operation of the overbed table, wherein the at least one human interface portion includes a visual indicator identifying it as the human interface portion.

20. The apparatus as recited in claim 19, wherein the visual indicator includes raised lettering and/or Braille lettering.

21. The overbed table of claim 9, wherein the support surface assembly includes a hand sanitizer container housing configured to receive a removable hand sanitizer container unit therein.

22. The overbed table of claim 21, wherein the housing includes a slot formed integrally with one of the first and second storage sections and is configured to receive the hand sanitizer container unit therein.

23. The overbed table of claim 21, wherein the housing includes at least one side wall configured to abut the hand sanitizer container unit.

24. The overbed table of claim 21, wherein the housing is sized to frictionally hold the unit therein.

25. The overbed table of claim 21, wherein the housing includes a locking portion configured to lock the unit within the housing.

26. An overbed table comprising:

a base assembly configured for placement of a support surface assembly adjacent a patient support apparatus, the support surface assembly coupled to the base assembly;

wherein the support surface assembly is configured to support an item thereon and wherein the support surface assembly is configured to be positionable over the patient support apparatus when the base assembly is adjacent the patient support apparatus, wherein the support surface assembly includes:

(i) a pair of movable table top sections; and (ii) a locking mechanism configured to prevent sliding translation of one of the table top sections in a first horizontal direction if the other table top section has been slidingly translated in the first horizontal direction.

27. The overbed table of claim 26, wherein the locking mechanism includes a pivot mechanism.

28. The overbed table of claim 27, wherein the pivot mechanism includes a generally triangular member pivotably coupled to a platform of the support surface assembly.

29. The overbed table of claim 28, wherein the platform is positioned below the pair of movable table top sections.

30. The overbed table of claim 28, wherein the pivot mechanism includes another generally triangular member pivotably coupled to the platform of the support surface assembly, and further wherein each table top section of the pair of table top sections is configured to engage one of the generally triangular members of the pivot mechanism when moved in a first or second direction.

31. An overbed table comprising:

a base assembly configured for placement of a support surface assembly adjacent a patient support apparatus, the support surface assembly coupled to the base assembly;

wherein the support surface assembly is configured to support an item thereon and wherein the support surface assembly is configured to be positionable over the patient support apparatus when the base assembly is adjacent the patient support apparatus, wherein the support surface assembly includes:

(i) a pair of movable table top sections; and (ii) a locking mechanism configured to prevent movement of one of the table top sections in a first direction if the other table top section has been moved in the first direction;

wherein each table top section of the pair of table top sections is configured to be movable in a second direction opposite the first direction when the other of the table top sections is moved in the first direction.

32. An overbed table comprising:

a base assembly;

a vertical support column coupled to the base assembly and configured to move upwardly and downwardly relative to the base assembly;

a support surface assembly coupled to the vertical support column and comprising a table top having a pair of movable table top sections, a locking mechanism configured to prevent movement of one of the table top sections in a first direction if the other table top section has been moved in the first direction,wherein each table top section of the pair of table top sections is configured to be movable in a second direction opposite the first direction when the other of the table top sections is moved in the first direction, the support surface assembly being configured to move upwardly and downwardly with the vertical support column relative to the base, the support surface assembly including a first storage section positioned adjacent a proximal end of the table top supported by the vertical support column, and a second storage section positioned adjacent a distal cantilevered end of the table top; and a sanitizer container positioned within a recessed portion of one of the first and second storage sections, the sanitizer container being configured to contain a sanitizer substance therein, wherein the sanitizer container further includes a dispenser configured to dispense the sanitizer substance contained within the sanitizer container upon actuation by a user.

33. The overbed table of claim 32, wherein the one of the first and second storage sections including the recessed portion further includes a locking portion configured to lock the sanitizer container within the recessed portion.

34. The overbed table of claim 32, wherein the recessed portion includes a narrower lower portion and the sanitizer container is configured to engage the narrower lower portion in an interface fit.

* * * * *